US011668115B2

(12) United States Patent
Fournier et al.

(10) Patent No.: US 11,668,115 B2
(45) Date of Patent: Jun. 6, 2023

(54) ADJUSTABLE BUTTON MECHANISM

(71) Applicant: Sargent Manufacturing Company, New Haven, CT (US)

(72) Inventors: Brian R. Fournier, Canton, CT (US); Christine Voelker, East Hampton, CT (US); Michael Bedford, East Hampton, CT (US); Todd Zimmer, Cromwell, CT (US); David Nguyen, Farmington, CT (US); Justin Harris, Milford, CT (US)

(73) Assignee: Sargent Manufacturing Company, New Haven, CT (US)

( * ) Notice: Subject to any disclaimer, the term of this patent is extended or adjusted under 35 U.S.C. 154(b) by 341 days.

(21) Appl. No.: 16/993,745

(22) Filed: Aug. 14, 2020

(65) Prior Publication Data

US 2021/0047859 A1 Feb. 18, 2021

Related U.S. Application Data

(60) Provisional application No. 62/887,475, filed on Aug. 15, 2019.

(51) Int. Cl.
*E05B 1/00* (2006.01)
*E05B 13/10* (2006.01)

(52) U.S. Cl.
CPC ..... *E05B 1/003* (2013.01); *E05B 1/0007* (2013.01); *E05B 1/0038* (2013.01); *E05B 13/105* (2013.01)

(58) Field of Classification Search
CPC ..... E05B 1/00; E05B 1/003; E05B 1/0007; E05B 1/0015; E05B 1/0038; E05B 1/0046; E05B 5/00; E05B 7/00; E05B 53/00; E05B 53/001; E05B 13/00; E05B 13/103; E05B 13/105
USPC ..... 292/214
See application file for complete search history.

(56) References Cited

U.S. PATENT DOCUMENTS 6,494,504 B1 * 12/2002 Fan ..... E05B 63/0017 292/1.5
6,536,812 B1 3/2003 Winardi
6,536,816 B1 * 3/2003 Fan ..... E05B 63/06 292/1.5
6,929,290 B2 * 8/2005 Don ..... E05B 55/005 292/DIG. 60
2005/0006911 A1 1/2005 Wu
2014/0238180 A1 * 8/2014 Huang ..... E05B 3/00 74/503
2019/0136575 A1 * 5/2019 Barker ..... E05B 17/048

OTHER PUBLICATIONS

International Search Report and Written Opinion for International Application No. PCT/US2020/046479, dated Nov. 9, 2020.

(Continued)

*Primary Examiner* — Nathan Cumar
(74) *Attorney, Agent, or Firm* — Wolf, Greenfield & Sacks, P.C.

(57) ABSTRACT

A button assembly for a door lock may include a button and a shank. The button may be toollessly couplable to the shank to allow force transmission between the button and the shank. The button may transfer linear force and torque along a longitudinal axis of the button to the shank to allow a state of an associated lock body to be changed.

23 Claims, 17 Drawing Sheets

(56) References Cited

OTHER PUBLICATIONS

International Preliminary Report on Patentability for International Application No. PCT/US2020/046479, dated Feb. 24, 2022.
PCT/US2020/046479, Feb. 24, 2022, International Preliminary Report on Patentability.

* cited by examiner

ADJUSTABLE BUTTON MECHANISM

RELATED APPLICATIONS

This application claims the benefit under 35 U.S.C. § 119(e) of U.S. Provisional Application Ser. No. 62/887,475, filed Aug. 15, 2019, which is herein incorporated by reference in its entirety.

FIELD

Disclosed embodiments are related to adjustable button mechanisms for door locks and related methods of use.

BACKGROUND

Mortise and bored locks are commonly employed on doors of various thicknesses. Depending on the thickness of the door, one or more components of the lock may be specified to fit that specific thickness of door. Accordingly, conventional locks are door size specific, and a lock arranged for one door size may not function properly on a door of a different size. Many conventional door locks employ a push or twist button disposed in an interior lever or knob which allows a user to selectively lock or unlock an interior or exterior lever or knob.

SUMMARY

In some embodiments, an adjustable button assembly includes a shank having a first end and a second end, where the shank is configured to connect to one or more components of a door lock on the second end. The button assembly also includes a button including a button coupler. One of the first end of the shank and the button coupler includes at least one engagement projection and the other of the first end of the shank and the button coupler includes at least two receptacles. The at least one engagement projection is configured to releasably engage a receptacle of the at least two receptacles. When the at least one engagement projection is engaged with one of the at least two receptacles the button is configured to transmit force to the shank along a longitudinal axis of the shank.

In some embodiments, a button assembly includes a shank having a first end and a second end, a button disposed on the first end of the shank, and a lock body coupler configured to be secured to a lock body of a door lock, where the lock body coupler is disposed on the second end of the shank. The lock body coupler includes a first spring and a second spring, wherein the first spring and second spring have different spring coefficients.

In some embodiments, a method of assembling a button assembly includes receiving a first end of a shank in a channel formed in the button, where a longitudinal axis of the button is inclined relative to a longitudinal axis of the shank. The method also includes rotating the button about an axis transverse to the longitudinal axis of the shank to move at least two engagement projections of the button into engagement with at least two receptacles forms in the shank.

In some embodiments, a method of assembling a button assembly includes actuating an actuator to move a position marker of a button from an engaged position to a disengaged position, where moving the position marker to the disengaged position disengages at least one engagement projection of the position marker from at least two receptacles of a shank. The method also includes sliding the button relative to the shank and moving the position marker from the disengaged position to the engaged position to engage the at least one engagement projection with the at least two receptacles.

It should be appreciated that the foregoing concepts, and additional concepts discussed below, may be arranged in any suitable combination, as the present disclosure is not limited in this respect. Further, other advantages and novel features of the present disclosure will become apparent from the following detailed description of various non-limiting embodiments when considered in conjunction with the accompanying figures.

BRIEF DESCRIPTION OF DRAWINGS

The accompanying drawings are not intended to be drawn to scale. In the drawings, each identical or nearly identical component that is illustrated in various figures may be represented by a like numeral. For purposes of clarity, not every component may be labeled in every drawing. In the drawings.

DETAILED DESCRIPTION

Figure 1:
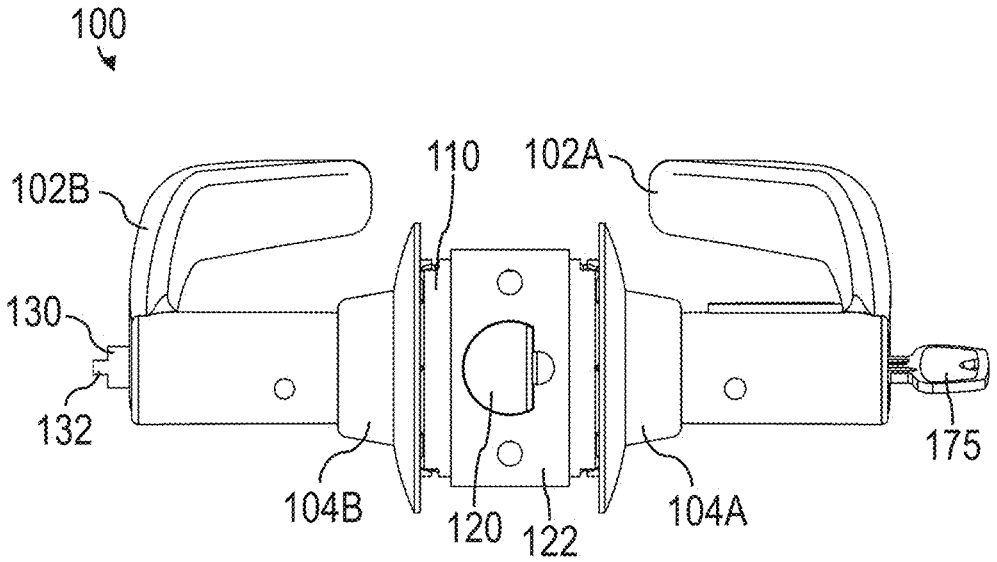
FIG. 1 is a side view of one embodiment of a bored cylindrical lock.

Conventional door locks oftentimes employ push or turn buttons on an interior door handle (e.g., a door lever, door knob, etc.) which allows a user without a key to secure an exterior door handle and/or interior door handle. For example, a push button may be depressed (i.e., moved into an interior door handle) to lock an exterior door handle. When the interior door handle is operated, the push button may automatically release the exterior handle and unlock the door. As another example, a turn button may be depressed and subsequently rotated. When the turn button is depressed and turned, both the interior and exterior door handles may be locked. To unlock the door, the turn button may be rotated in an opposite direction to release both handles and unlock the door. Conventional buttons generally have little adjustability and are packaged with a lock for a specified door thickness. For different door sizes and handle types, buttons having different overall lengths are employed to match the door.

In view of the above, the inventors have recognized the benefits of an adjustable button which allows a single lock and button assembly to be employed across a wide range of door thicknesses. In some embodiments, the button assembly may toollessly couple to a shank in a plurality of different positions. In one embodiment, a button may include two engagement projections which engage corresponding receptacles (e.g., notches) on the shank when the button is rotated into alignment with the shank. In another embodiment, the button may be linked to the shank with a pin disposed in a slot formed in the shank, allowing the button to be slid to a plurality of different positions. In some embodiments, the button assembly may be self-adjusting to a door thickness while allowing the button to be operated normally.

In some cases, conventional button assemblies must be removed before servicing or removing other components of a door lock. For example, the push button may inhibit a door handle from being removed and as a result, such conventional door locks are commonly damaged when an operator attempts to remove a door handle without first removing the push button.

In view of the above, the inventors have recognized the benefits of a button assembly which allows a button to be automatically removed alongside a door handle to prevent damage to either the door handle, button, or lock body. In one embodiment, removal of a door handle may rotate the push button out of engagement with a shank, decoupling the button from the shank and allowing the door handle to be freely removed. Such an arrangement may allow for damage prevention during installation, removal, and/or maintenance without compromising the functionality and force transmission of the button.

In some embodiments, an adjustable button assembly includes a shank and a button. The button may be releasably coupled to the shank in a plurality of positions so that the overall length of the button assembly may be adjusted. When the button is coupled to the shank, the button may be able to transmit linear force as well as rotational force about a longitudinal axis of the button to the shank. The shank may be coupled to one or more other components of a lock body so that the force transferred to the shank may be employed to modify a state of the lock body (e.g., lock or unlock the lock body). In some embodiments, the shank may also be releasably coupled to the lock body in a plurality of different positions so that the overall length of the button assembly extending from the lock body may be further modified. In one embodiment, the shank may include at least two receptacles on a first end and the coupler may include a corresponding at least two engagement projections. Each receptacle on the shank is respectively configured to receive a corresponding engagement projection disposed on the coupler. The at least two receptacles may be disposed on opposite sides of the shank and may be offset from one another along a longitudinal axis of the shank, so that when the each engagement projection is received in the corresponding receptacle, the button is secured to the shank and is able to transmit force. In another embodiment, the shank may include a slot extending along a longitudinal axis of the shank. The button may be secured to the slot with a pin, which allows the button to selectively translate to a plurality of positions. In some embodiments, the button may be releasably secured to the shank without the use of fasteners or tools. For example, the button may be secured to the shank with a rotation of the button about an axis transverse to a longitudinal axis of the shank.

In some embodiments, a button assembly may include a button disposed on a shank and a lock body coupler. The lock body coupler may couple the shank to a portion of the lock body and may include a first spring and a second spring. The first spring may be disposed between the lock body coupler and the lock body, while the second spring is disposed between the lock body coupler and the shank. The first spring and second springs may have different spring coefficients, so that the first spring urges the shank and button into a correct position relative to the lock body, while the second spring functions as a return spring when the button is operated (e.g., depressed or turned). The first spring coefficient may be much larger than the second spring coefficient, such that the button operates normally with a suitably low operational force. Such an arrangement may allow a button assembly to automatically adjust for a door thickness without significantly modifying the functionality of the button assembly.

In some embodiments, a button assembly may include an actuator that may be actuated by an operator to release a button and allow the button to move relative to a shank of the button assembly. In such an arrangement, the actuator may allow the button to slide relative to the shank to adjust an overall length of the button assembly without rotation of the button relative to the shank. In some embodiments, the actuator may include a shaft positioned in a slot of the shank. The actuator may also include a position marker configured to selectively engage the slot. The position marker and the slot may include complementary engagement projections (e.g., teeth) and receptacles (e.g., notches) such that when the position marker is engaged with the slot the position marker is not able to move along the slot. Accordingly, the position marker may selectively secure the actuator to the slot and inhibit relative movement of the actuator and the shank. The actuator may support a button coupler, so that a button attached to the button coupler is correspondingly secured to the shank. The slot of the shank may include multiple positions into which the position marker may be engaged, so that the overall length of the button assembly may be changed by an operator. In some embodiments, the shank may include an external profile configured to be received in the position marker. In such an embodiment, the external profile and the position marker may have complementary engagement projections and/or receptacles that mate to selectively secure the position marker to the shank. In some embodiments, the actuator may include a biasing member (e.g., a spring) configured to bias the position marker toward an engaged position. An operator may displace the position marker against the biasing force of the spring to move the position marker to a disengaged position, where the operator may then adjust the relative position of the position marker and the shank. Once the operator releases the actuator, the biasing member may move the position marker into the engaged position to secure the position marker to the shank. In some embodiments, the position marker moves transversely between the engaged position and disengaged position relative to a longitudinal axis of the shank.

It should be noted that while exemplary embodiments herein are described with reference to bored cylindrical locks, an adjustable button assemblies may be employed with any suitable locking device for a door or other access point. Additionally, while exemplary door handles such as levers and door knobs are discussed herein, adjustable buttons may be employed with any appropriate door handle, as the present disclosure is not so limited.

Turning to the figures, specific non-limiting embodiments are described in further detail. It should be understood that the various systems, components, features, and methods described relative to these embodiments may be used either individually and/or in any desired combination as the disclosure is not limited to only the specific embodiments described herein.

FIG. 1 is a side view of one embodiment of a bored cylindrical lock 100 which includes a push-turn button 130. As shown in FIG. 1, the lock includes two levers 102A, 102B on opposite sides of the cylindrical lock. An exterior lever 102A is surrounded by an exterior escutcheon 104A and receives a key 175 which may be used to operate the lock. The exterior escutcheon provides a transition between an associated door surface and the exterior lever, and may protect the internal components of the lock. An interior lever 102B is surrounded by a corresponding interior escutcheon 104B. As shown in FIG. 1, the push-turn button 130 is accessible from the interior lever and includes a tab 132 which allows the push-turn button to be easily rotated about its longitudinal axis. According to the embodiment of FIG. 1, both the push-turn button 130 and key 175 may be operated to change the state of a lock body 110 that controls the movability of a latch 120. The latch 120 projections from a latch plate 122 which may be secured to a door and guide the latch.

According to the embodiment of FIG. 1, the bored cylindrical lock 100 may be employed in an entrance or office, for example, where it may be desirable to avoid automatic release of the push-turn button. That is, the push-turn button 130 is moveable between an engaged (e.g., depressed) or disengaged (e.g., released) state. To move the push-turn button to the depressed state, the push-turn button may be pushed into the interior lever 102B and subsequently rotated using tab 132. Once the push-turn button has been rotated, the push-turn button may be retained in the depressed state. In the depressed state, the push-turn button may inhibit the rotation of either the interior lever 102B or the exterior lever 102A. Correspondingly, the latch 120 may be maintained in an extended position to secure a door. Force applied to either lever may not release the push-turn button. Instead, to unlock the lock 100, the tab 132 may be rotated in an opposite direction, whereupon the push-turn button may be moved back to the released position (e.g., by a biasing member such as a compression spring). When the push-turn button is in the depressed state, use of the key 175 may retract the latch 120 without unlocking the interior or exterior levers. Thus, according to one embodiment as shown in FIG. 1, operation of the cylindrical lock 100 may be based on force transmission between the push-turn button 130 and the lock body 110. In particular, linear force is transmitted along a longitudinal axis of the push-turn button, and torque is transmitted about the same longitudinal axis.

In one embodiment, the push-turn button 130 may also merely be depressed to change the state of the lock 100. For example, when the push-turn button is depressed, it may be retained in the depressed state without rotation of the push-turn button. In this second depressed state, the push-turn button may lock the exterior lever 102A and accordingly prevent the latch 120 from retracting when force is applied to the exterior lever. However, the interior lever 102B may remain unlocked, and rotation of the interior lever may release the push-turn button, thereby unlocking the exterior lever 102A and retracting the latch 120. Accordingly, the push-turn button of FIG. 1 may have two depressed states which lock different components of the cylindrical lock and require different actions to release the push-turn button.

Figure 2:
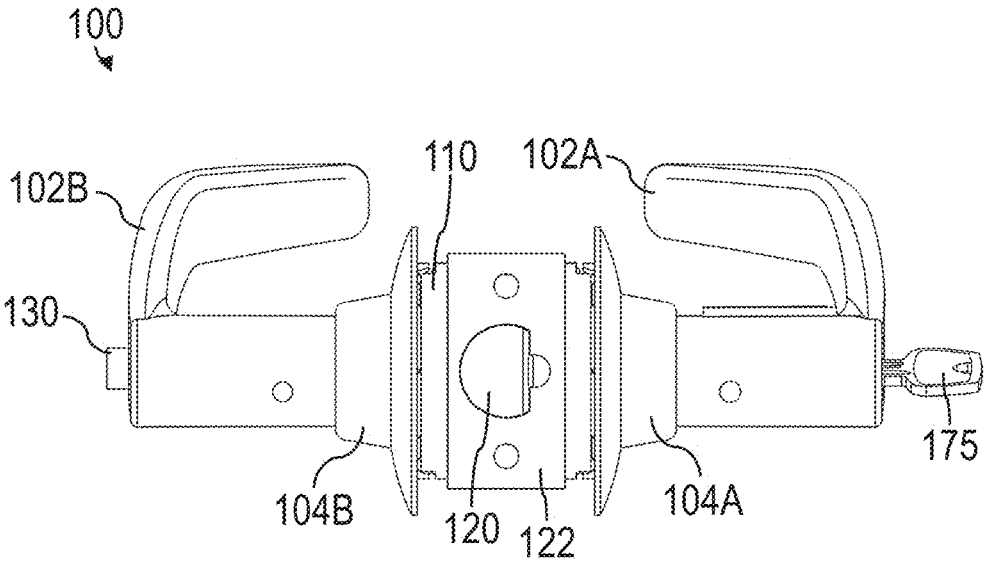
FIG. 2 is a side view of another embodiment of a bored cylindrical lock.

FIG. 2 is a side view of another embodiment of a bored cylindrical lock 100. Similarly to the bored cylindrical lock of FIG. 1, the lock includes an exterior lever 102A and an interior lever 102B, partially surrounded by escutcheons 104A, 104B. A lock body 110 controls the operability of the latch 120 between extended and retracted positions. The lock body is controlled by a key 175 from the exterior lever 102A, and by a push button 130 from the interior lever 102B. In contrast to the lock of FIG. 1, the push button 130 of FIG. 2 does not transmit rotational motion (e.g., about a longitudinal axis of the push button) to the lock body. Rather, the push button 130 in the embodiment of FIG. 2 merely transmits linear motion along the push buttons longitudinal axis. In some embodiments, when the push button is moved from a released to a depressed state, the push button may be retained in the depressed state and the exterior lever 102A may be correspondingly locked. To unlock the exterior lever, force may be applied to the interior lever 102B which releases the push button and unlocks the exterior lever.

Figure 3:
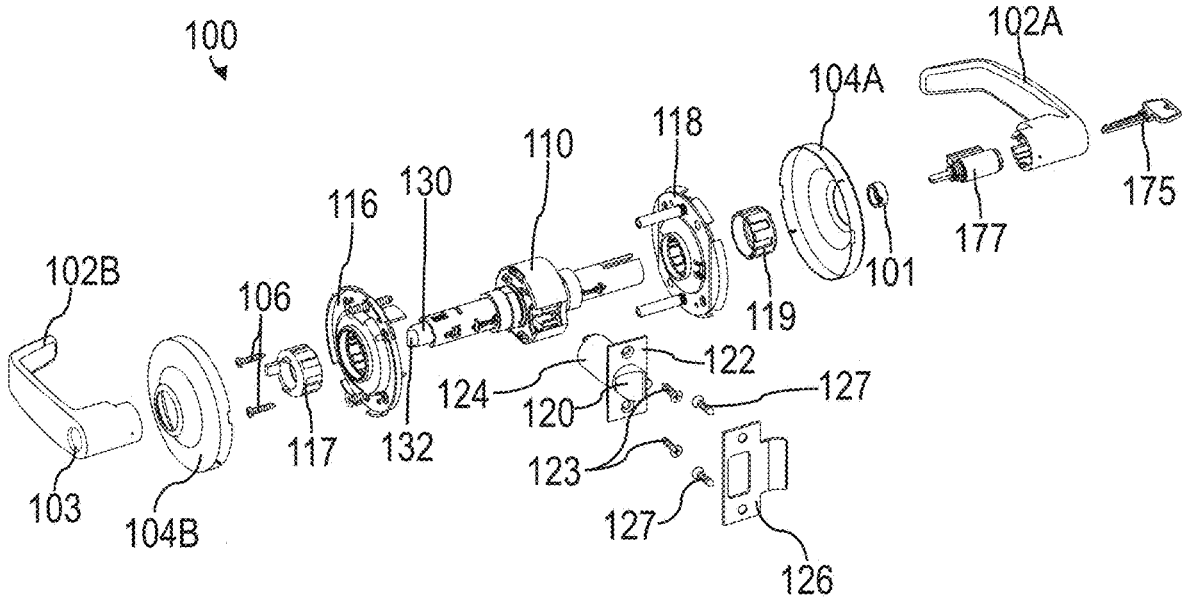
FIG. 3 is an exploded perspective view of the bored cylindrical lock of FIG. 2.

FIG. 3 is an exploded view of the bored cylindrical lock 100 of FIG. 1 showing the various components of the lock. As discussed previously, the lock includes an exterior lever 102A configured to be received and partially surrounded by an exterior escutcheon 104A. Similarly, the lock also includes an interior lever 102B configured to be received and partially surrounded by an interior escutcheon 104B. As shown in FIG. 3, the interior lever includes push button channel 103 that is configured to receive the push button 130. The lock of FIG. 3 also includes a lock body 110 configured to interface with the interior and exterior levers. The lock body controls the extension or retraction of the latch 120, transmitting rotation of the levers into linear translation of the latch. As shown in FIG. 3, the push button 130 is disposed in the lock body 110 and is configured to change the state of the lock body to control the movement of the interior lever, exterior lever, and/or latch 120. In one embodiment, a shank is coupled to the button 130 on one end and the lock body 110 on the other, and transmits any force applied to the button to the lock body. As shown in FIG. 3, the lock also includes an inside rose assembly 116 and an outside rose assembly 118 which secure the lock body 110 and the levers to an associated door. An inside spacer bushing 117 and outside spacer bushing 119 couple the levers to the lock body 110. Fasteners 106 may be used to fasten the inside rose assembly 116 to a door.

According to the embodiment shown in FIG. 3, the exterior lever 102A accommodates a lock cylinder 177 that is operable with a key 175. The lock cylinder is configured to be disposed in the exterior lever so that a keyhole is accessible from outside the external lever. The lock cylinder abuts a lock cylinder spacer 101 that provides appropriate spacing between the lock cylinder and the lock body 110. The lock cylinder engages the lock body 110 when operated with the key to change the state of the lock 100.

As shown in FIG. 3, the lock 100 includes a latch plate 122 and a latch guide 124 which both secure the latch in an associated door and allow the latch 120 to translate between extended and retracted positions. The latch plate 122 may be secured to an associated door with latch fasteners 123. The latch is configured to engage a strike plate 126 when the latch is in the extended position. The strike plate may be secured to an associated door jamb with strike fasteners 127.

Of course, while exemplary actions of a push-turn button and push button are discussed with reference to FIGS. 1-3, a button or other user interface may be moved in any desirable direction to change the state of a lock (e.g., the state of an interior lever, exterior lever, and latch). Additionally, while some exemplary shapes are shown in the embodiments depicted in FIGS. 1-3, a push button or push-turn button may have any suitable shape, as the present disclosure is not so limited.

Figure 4:
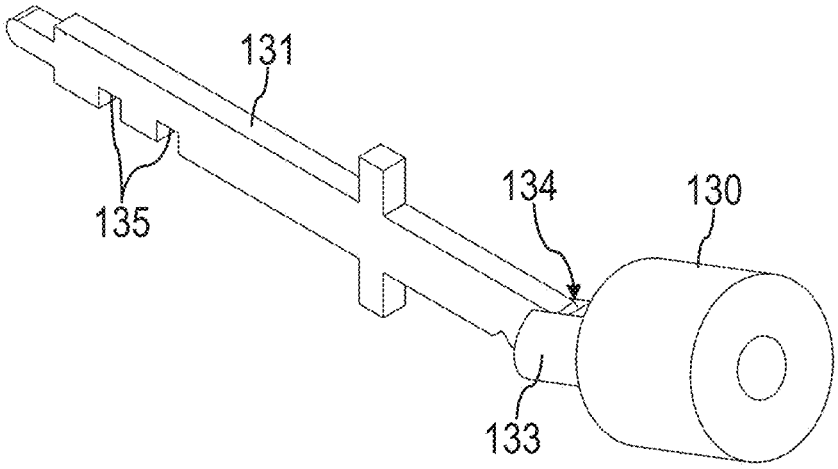
FIG. 4 is a perspective view of one embodiment of a button and button shank.

FIG. 4 is a perspective view of one embodiment of a button 130 and button shank 131 together forming an adjustable button assembly. According to the embodiment of FIG. 4, the button is releasably couplable to the button shank, and may be coupled without the use to tools or separate fasteners. As shown in FIG. 4, the button 130 in inclined relative to the shank 131. This position may correspond to a decoupled position, where the button 130 is movable relative to the shank. To couple the button 130 to the shank, the button may be rotated about an axis transverse to the longitudinal axis of the shank. In this way, the longitudinal axes of the button and the shank may be aligned and the button is coupled to the shank for force transmission. According to the embodiment shown in FIG. 4, the button includes a button coupler 133 that defines a channel configured to receive the shank 131. The channel and shank are sized and shaped such that rotation of the button and/or shank while the shank is disposed in the channel rotates both the button and the shank about their respective longitudinal axes. Accordingly, in the configuration shown in FIG. 4, the button 130 may be translated relative to the shank (with the shank moving through the channel) while relative rotation of the button about the longitudinal axis of the shank is inhibited by the channel. According to the embodiment of FIG. 4, the shank also includes lock body receptacles 135 that are configured to allow the shank to be coupled to other portions of the lock body and transmit force. For example, in some embodiments, one or more lock body projections may engage at least one of the lock body receptacles to couple the shank to the lock body.

Figure 5:
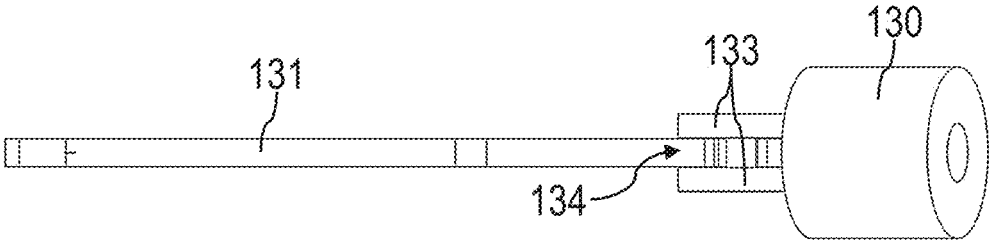
FIG. 5 is a top view of one embodiment of the button and button shank of FIG. 4.

FIG. 5 is a top view of one embodiment of the button 130 and button shank 131 of FIG. 4, better showing the arrangement of the shank 131 in the channel 134. According to the embodiment of FIGS. 4-5, the button coupler 133 has a smaller diameter than that of the button, and defines a central channel which receives the shank. Accordingly, when the shank is received in the channel, the longitudinal axes of the button 130 and shank 131 may be the same when viewed from the top. Of course, in other embodiments, the longitudinal axes may be parallel and offset, as the present disclosure is not so limited. Additionally, in one embodiment as shown in FIG. 5, the shank may include flat sides that correspond to flat walls of the channel 134. When the shank is received in the channel, the flat walls and flat sides may be parallel and in close contact with one another such that relative rotation of the button 130 about the longitudinal axis of the shank is inhibited. However, the flat sides and flat walls allow for sliding (e.g., translation) of the button 130 along the longitudinal axis of the shank. Additionally, such an arrangement allows the rotation of the button 130 about an axis transverse (e.g. perpendicular) to the longitudinal axis of the shank. According to some embodiments as will be discussed further herein, the ability to rotate about an axis transverse to the longitudinal axis of the shank (or button) allows the button 130 to be toollessly coupled to the shank. According to the embodiment shown in FIGS. 4-5, the shank 131 may have a shaped approximated as a rectangular prism.

Exemplary embodiments of adjustable button assemblies are described with reference to FIGS. 6A-8B. In each of FIGS. 6A-8B, a button coupler 133 of a button is shown transparently for clarity of the coupling interface between the button and a shank.

Figure 6A:
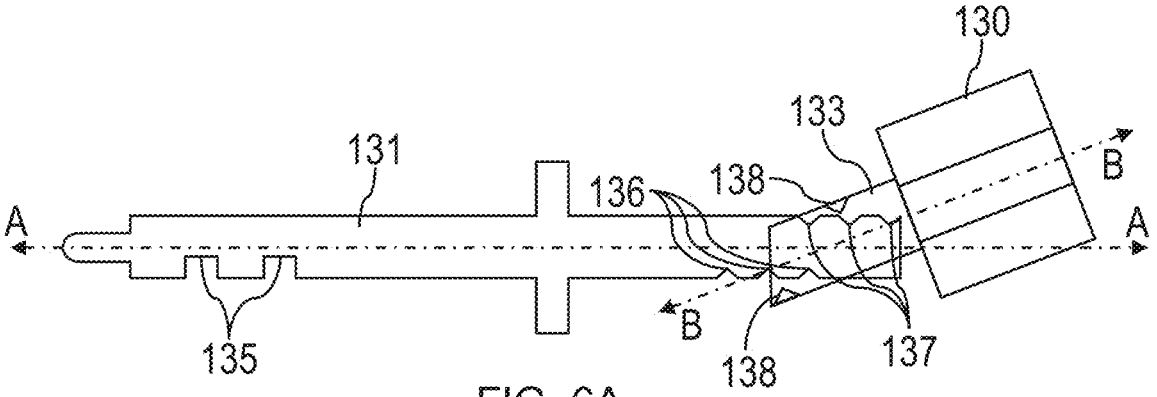
FIG. 6A is a side view of the button and button shank of FIG. 4 in a first position.

FIG. 6A is a side view of the button 130 and button shank 131 of FIG. 4 in a first position in which the button is decoupled from the shank. The button 130 is configured to move between an engaged position where the button is coupled to the shank for transmission of force and a disengaged position where the button is movable relative to the button. According to the embodiment of FIGS. 6A-6B, the button is configured to rotate about an axis transverse (e.g., perpendicularly) to a longitudinal axis A-A of the shank 131 between the engaged and disengaged positions. The button 130 includes a button coupler 133 that includes a channel as shown and described in FIGS. 4-5. As shown in FIG. 6A, the button coupler includes two engagement projections 138 which span the channel. The engagement projections 138 of FIG. 6A are arranged as triangular teeth oriented toward the shank 131 on opposite sides of the shank. The engagement projections 138 are offset from one another along a longitudinal axis B-B of the button 130, and are disposed on opposite sides (e.g., a top side and a bottom side) of the button coupler 133.

According to the embodiment shown in FIG. 6A, the shank 131 includes a plurality of receptacles 136, 137 (e.g., notches) which are configured to receive the engagement projections 138. When the engagement projections are received in the receptacles, the button 130 is secured to the shank so that force transmission is allowed between the button and the shank. As shown in FIG. 6A, the receptacles include a plurality of upper receptacles and a plurality of lower receptacles 136 which are positioned on opposite sides of the shank 131. Each of the plurality of upper receptacles 137 includes a corresponding lower receptacle 136 offset from one another to accommodate both of the engagement projections 138 concurrently. The plurality of upper receptacles and plurality of lower receptacles are offset from one another a distance equal to the offset between the engagement projections 138. Each of the receptacles has a shape corresponding to the shape of the engagement projections, allowing force transmission between the engagement projections and the receptacles. Each pair of receptacles defines a locking region in which the button may be coupled to the shank to adjust the overall length of the button and shank assembly. In one embodiment as shown as FIG. 6A, the engagement projections and receptacles have a triangular shape. Of course, the engagement projections and receptacles may have any suitable shape, as the present disclosure is not so limited, and the engagement projections and receptacles need not be corresponding in shape provided they are compatible in shape to allow a suitable coupling.

Figure 6B:
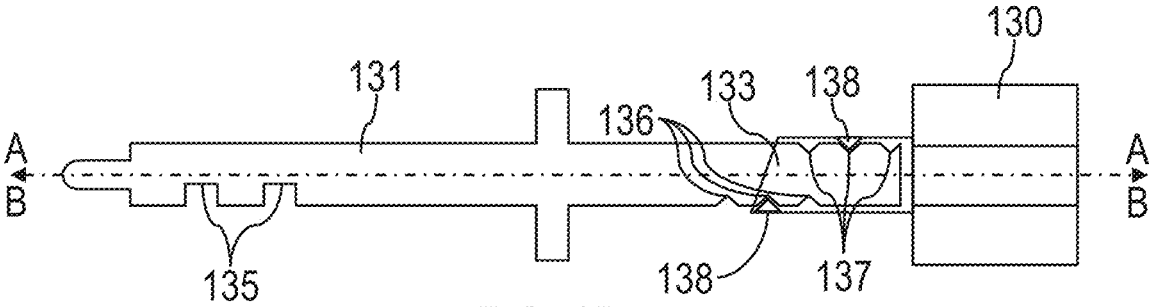
FIG. 6B is a side view of the button and button shank of FIG. 4 in a second position.

FIG. 6B is a side view of the button 130 and button shank 131 of FIG. 4 in a second position where the button is secured to the shank. Compared with the position shown in FIG. 6A, the button 130 has been rotated about an axis transverse (e.g., perpendicular) to the longitudinal axes A-A and B-B of the shank and button. Put another way, the button is rotated downward relative to the shank from the position in FIG. 6A to the position shown in FIG. 6B. In the position shown in FIG. 6B, each of the engagement projections 138 is engaged with a corresponding upper receptacle 137 and a lower receptacle 136. Accordingly, in this position, the longitudinal axes of the button B-B and shank A-A, are aligned and coincident with one another. As the button 130 is rotated relative to the shank 131, the engagement projections effectively clamp onto the shank 131 as both move toward the shank concurrently. Once in the position of FIG. 6B, force may be transmitted from the button 130 to the shank 131 and vice versa. In particular, linear force along the aligned longitudinal axes may be transferred from the button through the engagement projections to the shank. Furthermore, as discussed above, torque about the longitudinal axes may be transferred via the channel (see FIG. 5) and/or, in some embodiments, the engagement projections 138.

In one embodiment as shown in FIG. 6B, gravity may retain the button 130 in the engaged position. The button 130 may have a weight distribution such that gravity generates a moment on the button 130 that urges the engagement projections 138 into further engagement with the receptacles 136. Put another way, gravity urges the button 130 to rotate clockwise relative to the page. Accordingly, the button 130 may be retained in the coupled position until external force is applied to rotate the button in an opposite direction (e.g., counterclockwise relative to the page).

In some embodiments, a door handle may retain the button 130 in the engaged position. For example, a hole in the door handle may receive the button 130, such that the door handle constrains the button to translate or rotate about the longitudinal axis A-A along with the button shank 131. The door handle may be selectively attachable or detachable to correspondingly constrain or allow movement of the button 130. Accordingly, when a door lock is fully assembled with handles, the button 130 and shank 131 combination may functionally operate as a single component, as the button 130 may be unable to move to the disengaged position while the handle is attached.

Figure 7A:
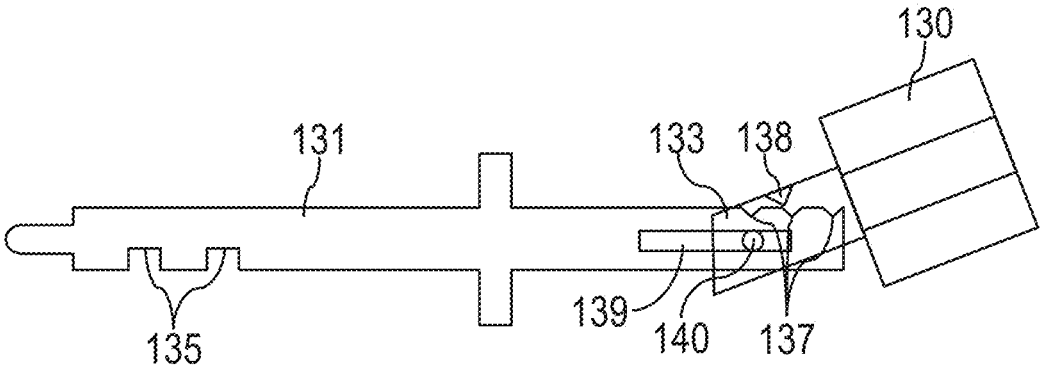
FIG. 7A is a side view of another embodiment of a button and button shank in a first position.
Figure 7B:
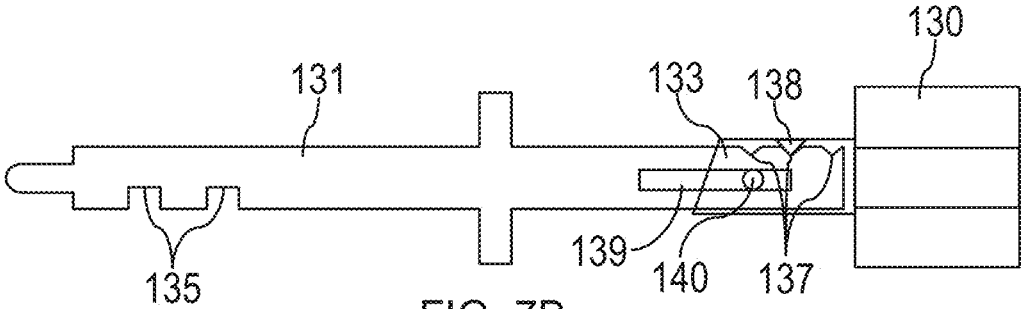
FIG. 7B is a side view of the button and button shank of FIG. 7A in a second position.

FIG. 7A is a side view of another embodiment of a button 130 and button shank 131 in a first position corresponding to a disengaged position. Similarly to the embodiment of FIGS. 6A-6B, the button 130 is rotated between engaged and disengaged positions with the button shank 131. The shank 131 may be received in a channel formed in a button coupler 133, so that rotational motion of the button or shank about its respective longitudinal axis is transferred to the other. According to the embodiment of FIG. 7A, the shank 131 only includes a plurality of upper receptacles 137, each of which define a locking region in which the button can be secured to the shank. The button coupler 133 includes an engagement projection 138 that spans a channel of the button coupler is positioned on an upper (e.g., top) portion of the button coupler. In contrast the embodiment of FIGS. 6A-6B, the button coupler 133 includes a pin 140 that is disposed in a slot 139 formed in the shank 131. In the embodiment of FIGS. 7A-7B, the slot extends in a direction along the longitudinal axis of the shank, and slidably secures the pin 140 to the shank. Accordingly, in the disengaged position, the button 130 is slidably coupled to the shank via the pin 140, with the position of the button remaining adjustable relative to the shank.

In the embodiment of FIG. 7A, the pin 140 and the engagement projection 138 are offset from one another and together constitute two interfacing elements, which engage the shank 131 to selectively couple the button 130 to the shank. Similarly to the embodiment of FIGS. 6A-6B, the engagement projection 138 and pin 140 engage opposite sides of the shank. In the embodiment of FIG. 7A, the engagement projection 138 is configured to engage a top side of the shank where the plurality of receptacles 137 is disposed, while the pin 140 is configured to engage a downward facing surface of the slot 139. Thus, when the button 130 is rotated downward (e.g., clockwise relative to the page), the engagement projection 138 and pin 140 clamp onto the shank 131 to secure the position of the button and allow linear force transmission between the button and the shank, as shown in FIG. 7B.

FIG. 7B is a side view of the button 130 and button shank 131 of FIG. 7A in a second position corresponding to an engaged position. In the engaged position shown in FIG. 7B, the button 130 is effectively secured to the shank so that their relative positioning and overall length remain unchanged without first decoupling the button from the shank. The engagement projection 138 has engaged a corresponding receptacle 137 while the pin 140 resists further rotation of the button downwards (e.g., relative to the page). As the engagement projection and receptacle have corresponding shapes, force applied to the button 130 may be transmitted to the shank along the longitudinal axis of the shank. Additionally, as noted previously, a channel of the button 130, the pin 140, and/or the engagement projection 138 may transmit torque to the shank in combination or individually.

According to the embodiment of FIGS. 7A-7B, the pin 140 may be permanently or semi-permanently fixed to the button coupler 133, meaning the button 130 and shank 131 assembly may be integrated and manufactured as a single part. For adjustment of the button to a desired position, the button may simply be lifted (e.g., rotated in an upward direction corresponding to counterclockwise relative to the page) until the engagement projection 138 clears the receptacles 137, slid along the slot to the desired position, and rotated in an opposite direction (e.g., downward direction corresponding to a clockwise relative to the page).

Figure 8A:
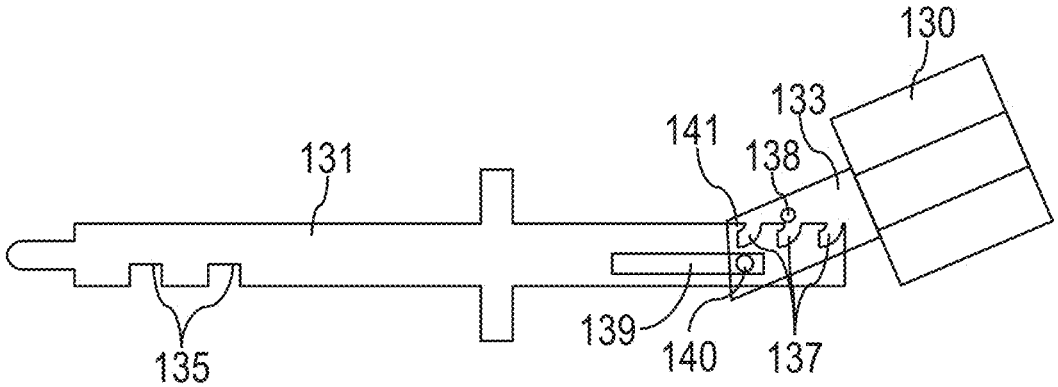
FIG. 8A is a side view of another embodiment of a button and button shank in a first position.

FIG. 8A is a side view of another embodiment of a button 130 and button shank 131 in a first position corresponding to a disengaged position. The embodiment of FIG. 8A is similar to that of FIGS. 7A-7B, insofar as the shank includes a plurality of upper receptacles 137 and a slot 139, while the button 130 includes an engagement projection 138 and a pin 140. However, in contrast to the embodiment of FIGS. 7A-7B, the receptacles of FIG. 8A are arcuate with a perpendicular end wall, which may allow for more reliable force transmission between the button 130 and the shank 131, as well as inhibit accidental movement of the button 130 to the disengaged position. In one embodiment as shown in FIG. 8A, the receptacles 137 may extend from a top surface of the shank 131 and curve rearward relative to the shank (i.e., away from the button 130). The end of each of the receptacles is configured as a substantially flat surface (see 142 in FIG. 8B) which is disposed in a plane perpendicular to a longitudinal axis of the shank. At the entrance to each receptacle is a lip 141 formed on a rearward side of the receptacle furthest away from the button 130. The lip 141 is configured to contact the engagement projection 138 to inhibit accidental lifting of the button 130. The engagement projection 138 is sized and shaped to fit into each of the receptacles. In one embodiment, the engagement projection is circular to promote even sliding into and out of each of the receptacles, as will be discussed with reference to FIG. 8B.

Figure 8B:
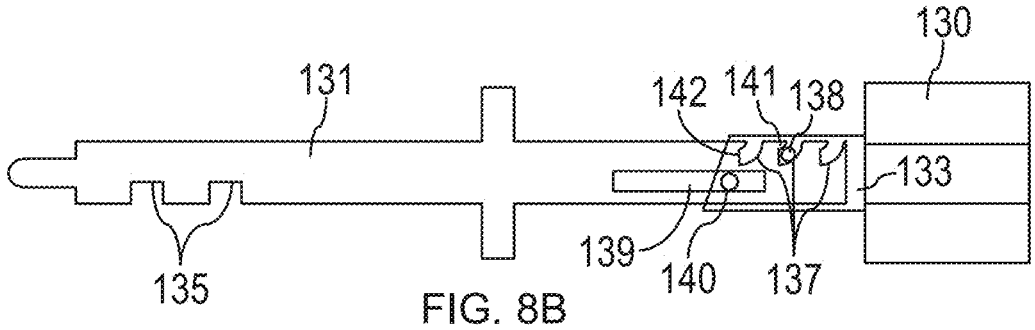
FIG. 8B is a side view of the button and button shank of FIG. 8A in a second position.

FIG. 8B is a side view of the button 130 and button shank 131 of FIG. 8A in a second position corresponding to an engaged position. As shown in FIG. 8B, the engagement projection 138 is disposed in a receptacle 137 and, in combination with the pin 140, applies a clamping force to the shank 131 to secure the button 130 to the shank 131 when the button is aligned with the shank. The engagement projection 138 abuts and contacts the flat surface 142 of the receptacle 137. As this flat surface is substantially perpendicular to the longitudinal axis of the shank 131, force applied to the button 130 may be transferred to the shank 131 along the longitudinal axis without resultant normal force vectors urging the button 130 out of the engaged position. Accordingly, the receptacle of FIGS. 8A-8B may allow for consistent and reliable linear force transmissions between the button 130 and the shank 131.

In addition to linear force transmission, the lip 141 retains the engagement projection 138 in the receptacle 137. That is, the lip 141 blocks a path of the engagement projection 138 if the button 130 was merely rotated upward (i.e., counterclockwise relative to the page). Instead, to move the engagement projection 138 out of the receptacle, a two part action must be performed. In the embodiment of FIGS. 8A-8B, a pulling force (e.g., a force applied to the button in a direction away from the shank) must be applied to the button as the button on is rotated upward, allowing the engagement projection to clear the lip 141 as the engagement projection remains in contact with and slides up a side of the receptacle nearest the button. Accordingly, the embodiment of FIGS. 8A-8B inhibits accidental force from lifting the button 130 out of engagement with the shank. The two-part action may still allow consistent movement of the button 130 between the engaged and disengaged positions, allowing a user to easily select a position corresponding to an appropriate overall length of the button and shank assembly.

Figure 9:
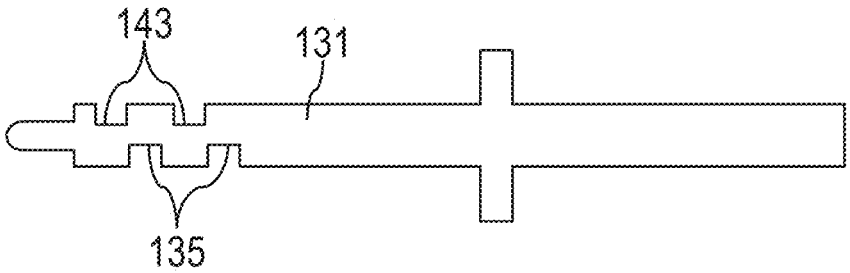
FIG. 9 is a side view of another embodiment of a button shank.
Figure 10:
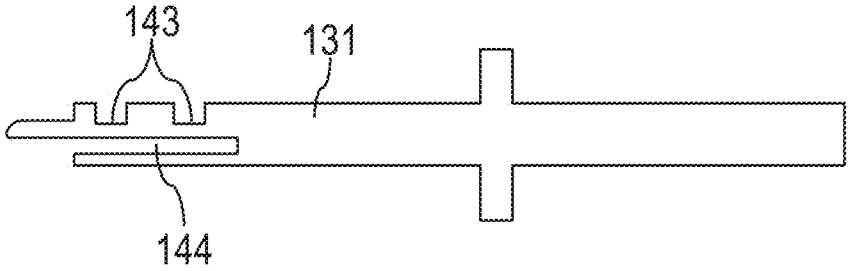
FIG. 10 is a side view of yet another embodiment of a button shank.

FIGS. 9-10 are side views of two alternative embodiments of a button shank showing different lock body coupling arrangements. According to the embodiments shown in FIGS. 9-10, the shank 131 may employ a similar, releasable coupling arrangement between the shank and a portion of a lock body. That is, one or more portions of a lock body may include shank engagement projections that selectively engage one of more locking regions of the shanks 131 shown in FIGS. 9-10. The shanks 131 of FIGS. 9-10 may engage the lock body toollessly. According to the embodiment shown in FIG. 9, the shank includes lower lock body receptacles 135 and upper lock body receptacles 143, where the at least two lock body receptacles include a first notch disposed on a first side of the shank and a second notch disposed on a second side of the shank opposite the first side. The upper and lower lock body receptacles are offset from one another and are configured to receive corresponding offset portions of a lock body in a similar manner to the receptacles 136, 137 of FIGS. 6A-6B. The shank 131 of FIG. 9 may be inserted into a lock body portion at an angle (or conversely, the lock body portion may be angled) and then rotated to secure the shank to the lock body. According to the embodiment of FIG. 10, the lower lock body receptacles 135 are replaced with a slot 144 that extends from a rear end of the shank 131. The open-ended slot 144 is configured to receive a pin or other projection of a lock body, which slides along the slot in a manner similar to the slot 139 of the shank of FIGS. 7A-7B. The slot 144 may guide the lock body pin or projection as the shank is received in the lock body, whereupon the shank may be rotated to secure the shank to the lock body via upper lock body receptacles 143. While the lock body receptacles of FIGS. 9-10 are shown as rectangular slots, any suitable shape for the receptacles may be employed, as the present disclosure is not so limited.

Figure 11A:
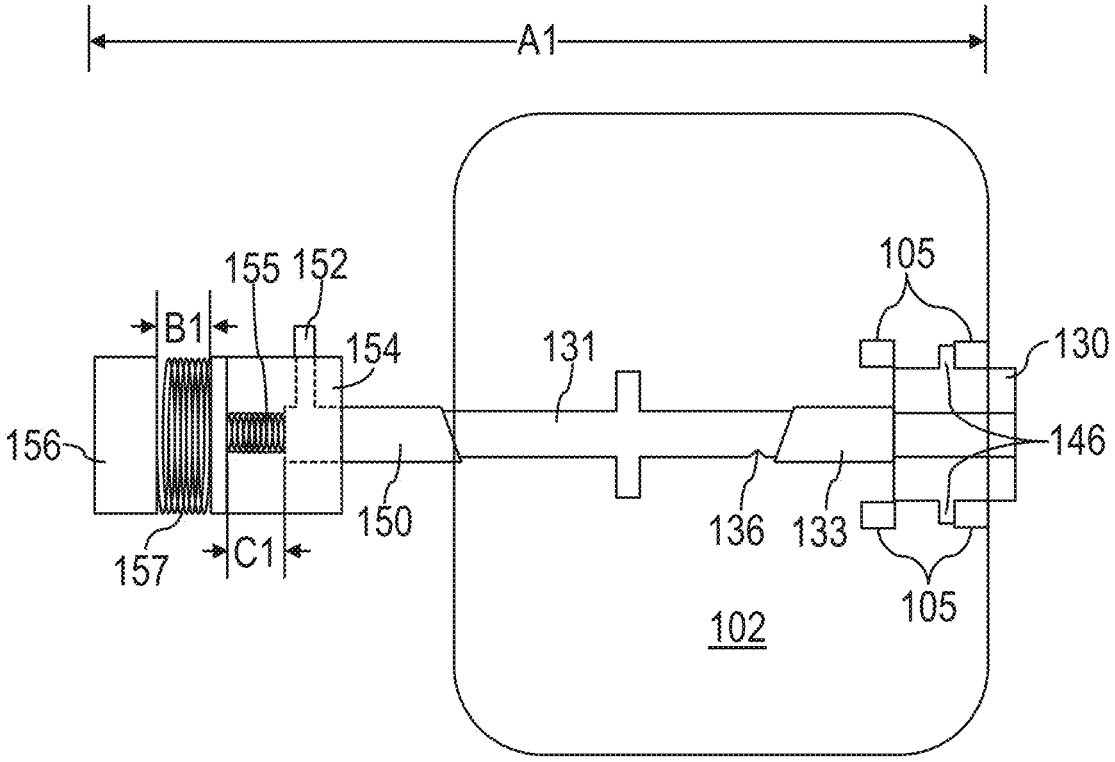
FIG. 11A is a side schematic view of one embodiment of a button disposed in a door handle in a first position.
Figure 11B:
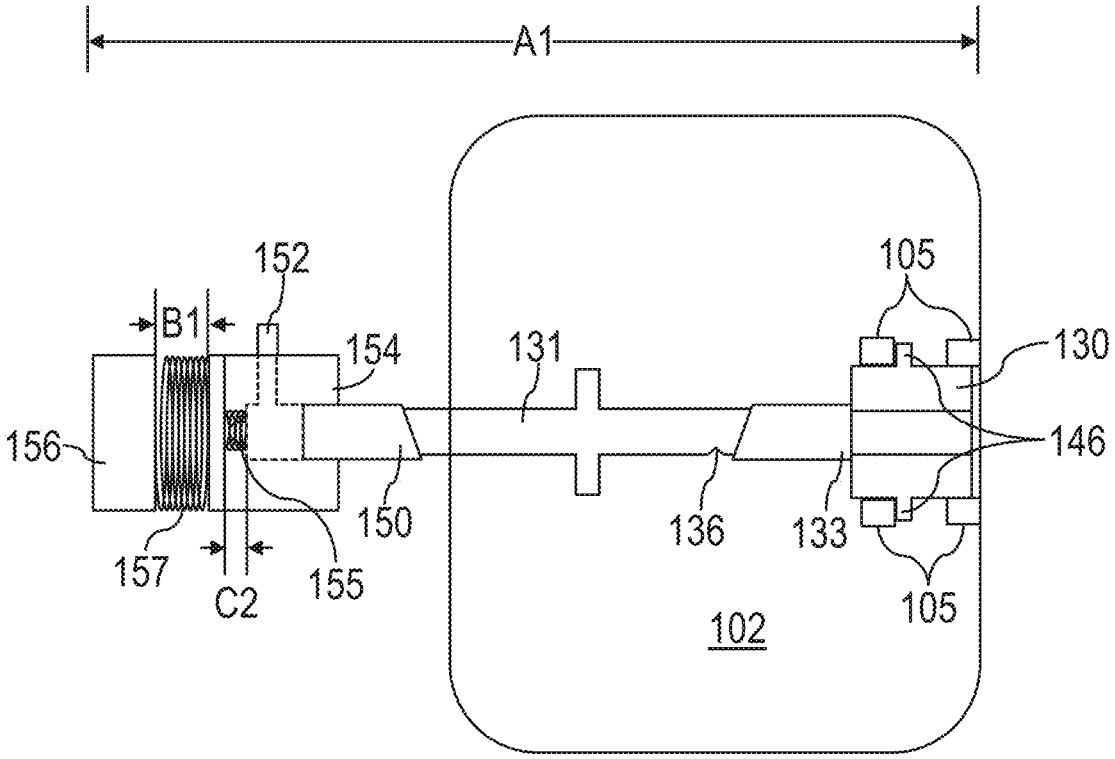
FIG. 11B is a side schematic view of the button of FIG. 11A in a second position.
Figure 11C:
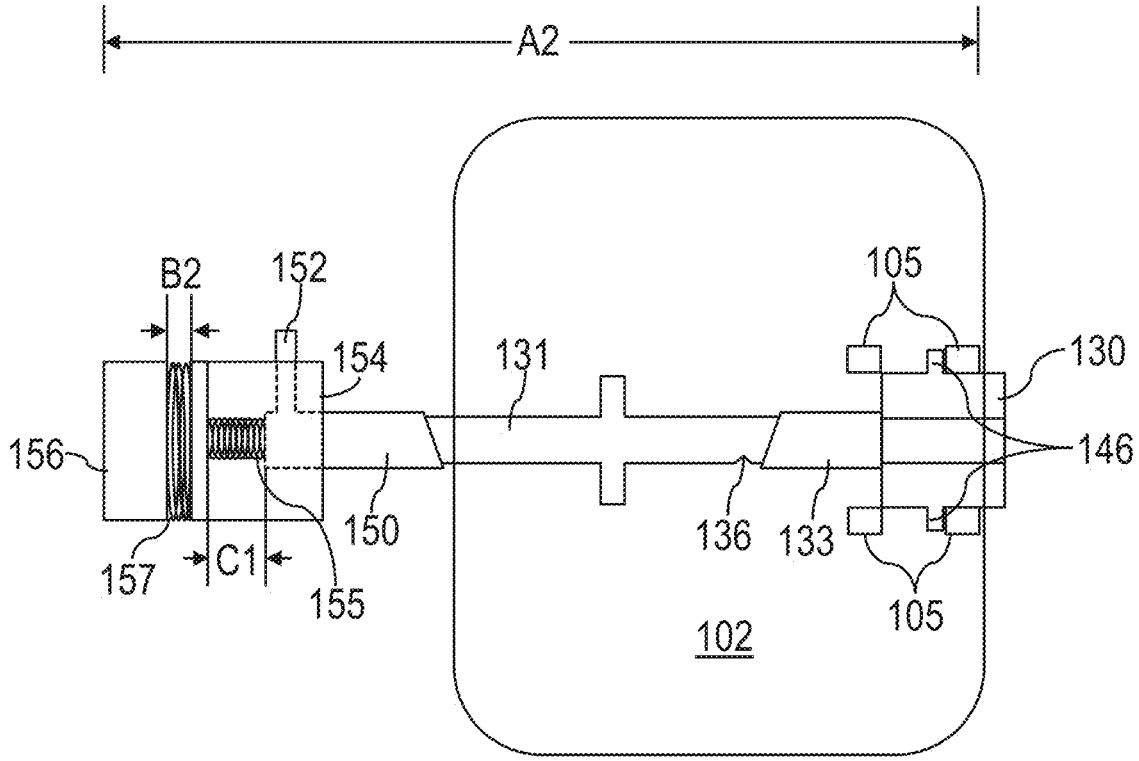
FIG. 11C is a side schematic view the button and door handle of FIG. 11A in a third position.

FIGS. 11A-11C depict various positions of a button assembly configured to automatically adjust the overall length of the button assembly to accommodate and/or handles of different thicknesses. That is, the button assembly automatically moves into an operative position in a door handle without manual intervention of a user. According to the embodiment of FIGS. 11A-11C, the button assembly employs two springs of differing spring coefficients that maintain a desired operational force of the button while allowing the button assembly to lengthen or shorten based on the thickness of the door and/or door handle.

FIG. 11A is a side schematic view of one embodiment of a button 130 disposed in a door handle 102 in a first position corresponding to an operative resting position. As shown in FIG. 11A, the button 130 is coupled to a shank 131 via a button coupler 133. For example, the button coupler 133 may be similar to that shown in FIGS. 6A-6B and toollessly coupled to the shank via receptacles 136 formed on a button end of the shank. Of course, in some embodiments, the button 130 may be integrally formed with the shank or fastened to the shank using any suitable arrangement. According to the embodiment of FIG. 11A, the button 130 includes guides 146 which project from sides of the button and are configured to guide the button 130 between depressed and released positions. In particular, the guides 146 move between stoppers 105, which are integrated with the door handle 102 and define the range of motion of the button 130.

At an opposite end of the shank 131 is a lock body coupler 150, which connects the shank to the lock body and allows for length adjustment of the overall button assembly. The lock body coupler includes an activation tab 152, a first housing 154, and a second housing 156. The activation tab 152 is linked to the shank 131 and is configured to engage other portions of the lock body to change the state of the lock body when the push button 130 is moved from the released position shown in FIG. 11A to an engaged or depressed position as shown in FIG. 11B. The activation tab 152 may also retain the push button 130 in the depressed position until the door handle 102 is turned or the push button is otherwise released. Of course, the push button may have any suitable functional interface between the shank and the lock body to allow the state of the lock body to be changed via activation of the push button in either push or turn, as the present disclosure is not so limited. According to the embodiment of FIG. 11A, the activation tab 152 is separated from the first housing 154 by a first spring 155, and the first housing is separated from the second housing 156 by a second spring 157 where the first spring and the second spring urge the button toward the handle. Accordingly, the activation tab 152, first housing 154, and second housing 156 may each by moved semi-independently from one another. The second housing 156 may be secured to a lock body, the door, or other component, which establishes a base from which the button assembly may lengthen or shorten. Put another way, the second housing 156 may be fixed relative to the lock body and/or door.

As shown in FIG. 11A, the first spring 155 and second spring 157 are both arranged as compression springs, but each has a different spring constant providing a different stiffness against displacement of the button 130. According to the embodiment of FIG. 11A, the second spring 157 has a spring coefficient larger than that of the first spring 155 (or alternatively put, the first spring 155 has a spring coefficient lower than that of the second spring 157). The second spring 157 is configured to adjust the overall length of the button assembly, while the first spring 155 is configured to provide a biasing force to resist depression of the button 130 and to return the button 130 to the released position. The second spring 157 provides a biasing force against the first housing 154 to move the first housing toward the door handle 102 and lengthen the overall length of the button assembly A1. The resulting second distance B1 between the first housing and the second housing is adjusted based on the overall thickness of the door and door handle. In some embodiments, the door handle 102 may include stops that abut the first housing 154 and determine an appropriate overall length of the button assembly. The first spring 155 applies a force to the shank 131 via the activation tab 152 to move the button 130 to a released position, establishing a third distance C1 between the first housing and the activation tab.

FIG. 11B is a side schematic view of the button 130 of FIG. 11A in a second position corresponding to a depressed position of the button. As shown in FIG. 11B, the button 130 has been depressed into the door handle 102. The guides 146 abut stoppers 105 defining the depressed position. Relative to FIG. 11A, the first spring 155 with a lower spring coefficient compresses to a much greater extent than the second spring 157 to a distance C2 which is less than C1. In particular, the second spring 157 has a comparatively high spring coefficient (i.e., stiffness), such that the second distance B1 remains relative unchanged relative to the position shown in FIG. 11A. The spring coefficient of the first spring 155 may be selected such that depressing the button 130 is easy compared with the force necessary to compress the second spring 157 a similar distance.

FIG. 11C is a side schematic view the button 130 and door handle 102 of FIG. 11A in a third position where the button assembly is disposed in a door of a lesser thickness. As shown in FIG. 11C, the overall length A2 of the button assembly based on the handle 102 is less than that in FIGS. 11A-11B, meaning the button assembly is shortened relative to positions shown previously. In particular, as discussed previously, the second spring 157 is compressed to a distance B2 that is less than B1. However, the first spring 155 remains at approximately the same compression distance as FIG. 11A at C1, which may be an appropriate distance to allow the push button to move from the released position shown in FIG. 11C to a depressed position. Accordingly, regardless of the compression distance of the second spring 157, the first spring 155 may accommodate a full range of motion for the button 130 between depressed and released positions.

While compression springs are shown in FIGS. 11A-11C, any suitable biasing member may be employed including tensions springs, torsion springs, air springs, etc., as the present disclosure is not so limited.

Figure 12:
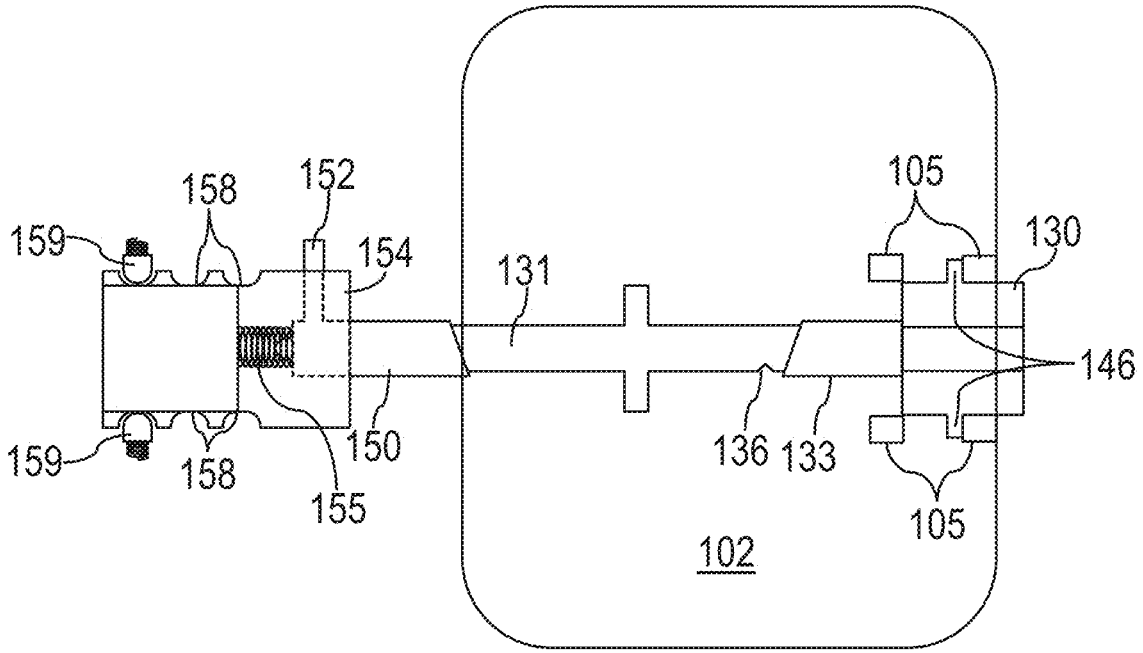
FIG. 12 is a side schematic view of another embodiment of a button disposed in a door handle.

FIG. 12 is a side schematic view of another embodiment of a button 130 disposed in a door handle 102 including an arrangement for simple relative length adjustment of the button assembly. As shown in FIG. 12, the button assembly is similar to that of FIGS. 11A-11C, where a button 130 including guides 146 moves between depressed and released positions defined by stoppers 105. A shank 131 couples to the button to an activation tab 152 which is coupled to a housing 154 via a compression spring 155. In the embodiment of FIG. 12, the housing includes a plurality of detent receptacles 158 arranged on the sides of the housing. The detent receptacles are configured to receive spring loaded ball detents 159 that releasably secure the first housing 154 to a lock body. The ball detents may releasably secure the first housing to a lock body up to a threshold force, whereupon the ball detents may be moved out of the detent receptacles 158 and the position of the housing 154 may be adjusted relative to the lock body. Accordingly, the effective length of the shank 131 and button 130 extending into the door handle 102 may be adjusted by selecting a desired position for the ball detents 159 in the detent receptacles 158. In some embodiments, such an adjustment may be completed toollessly with application of a threshold force to the button 130.

Figure 13A:
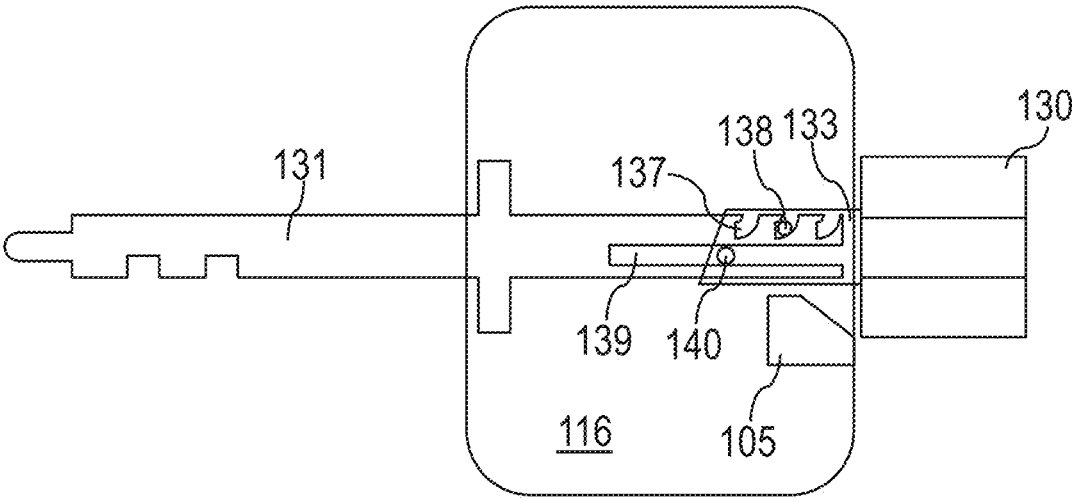
FIG. 13A is a side schematic view of another embodiment of a button disposed in a rose assembly in a first position.
Figure 13B:
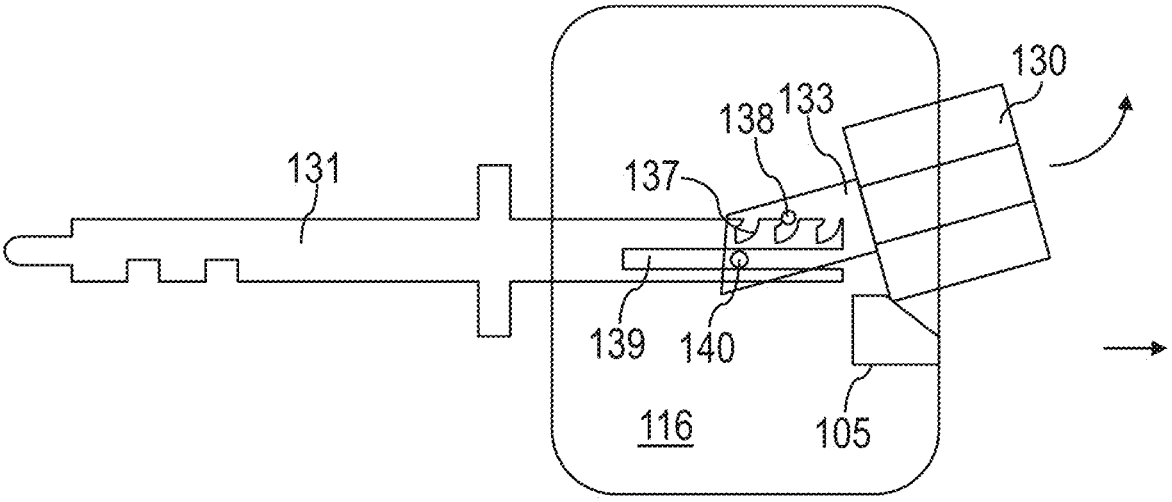
FIG. 13B is a side schematic view of the button and rose assembly of FIG. 13A in a second position.

FIGS. 13A-13B are side schematic views of another embodiment of a button 130 disposed in a rose assembly 116 demonstrating the ability of the button to avoid damage to itself and to the rose assembly in the case of improper installation or disassembly. According to the embodiment shown in FIGS. 13A-13B, the shank 131 and button are similar to that of FIGS. 8A-8B, including arcuate receptacles 137 and a slot 139. However, in the embodiment of FIGS. 13A-13B, the slot 139 is open on one end to allow the pin 140 to selectively enter or exit the slot. As shown in FIG. 13A, the rose assembly 116 includes a stopper 105, which during normal operation may define a depressed position or an end of a range of motion of the button 130. In FIG. 13A the button 130 may be in a normal operative position where the button 130 is released and actuable to a depressed position to change the state of an associated lock body.

FIG. 13B depicts one example of an improper disassembly of the rose assembly 116, where the rose assembly is pulled prior to appropriate removal of the button 130 and/or shank 131. For fixed buttons, the stopper 105 may strike the button and the button may not yield, preventing further removal of the rose assembly. However, continued pulling force application may bend or otherwise damage the button, shank, and/or rose assembly, which may require replacement of one or more components of the button assembly, lock body, or rose assembly. However, according to the embodiment of FIGS. 13A-13B, the button 130 is automatically removed when such a force is applied, thereby avoiding this damage. As shown in FIG. 13B, the stopper 105 strikes the button 130, generating a moment on the button 130 shown by the curved arrow. The generated moment moves the engagement projection 138 up and out of the receptacle 137 as the button 130 pivots about pin 140. Once the engagement projection 138 clears the receptacle 137, the button does not resist further movement of the rose assembly 116. According to the embodiment of FIGS. 13A-13B, the stopper 105 is configured as a ramp that allows the button 130 to ride up and over the stopper when the rose assembly 116 is removed. Of course, any suitable shape may be employed for the stopper 105, including ramped and non-ramped surfaces, as the present disclosure is not so limited. In one embodiment, the button may be removed from the shank with the rose assembly 116 as the pin 140 is moved out of the slot 139. In an alternative embodiment, the button may be rotated sufficiently by the moment to clear the stopper 105. In either embodiment, the button 130 does not significantly resist the removal of the rose assembly 116, thereby avoiding damage that may otherwise by caused by forcibly pulling on the rose assembly.

While the embodiments of FIG. 13A-13B are described with reference to a rose assembly 116, in other embodiments another component of a door lock may contact the button 130 to rotate the button to the disengaged position to inhibit damage to the various components of the door lock. For example, in some embodiments, a spacer bushing 117 may contact the button to rotate the button 130 to the disengaged position, as discussed with reference to FIGS. 14A-14B.

Figure 14A:
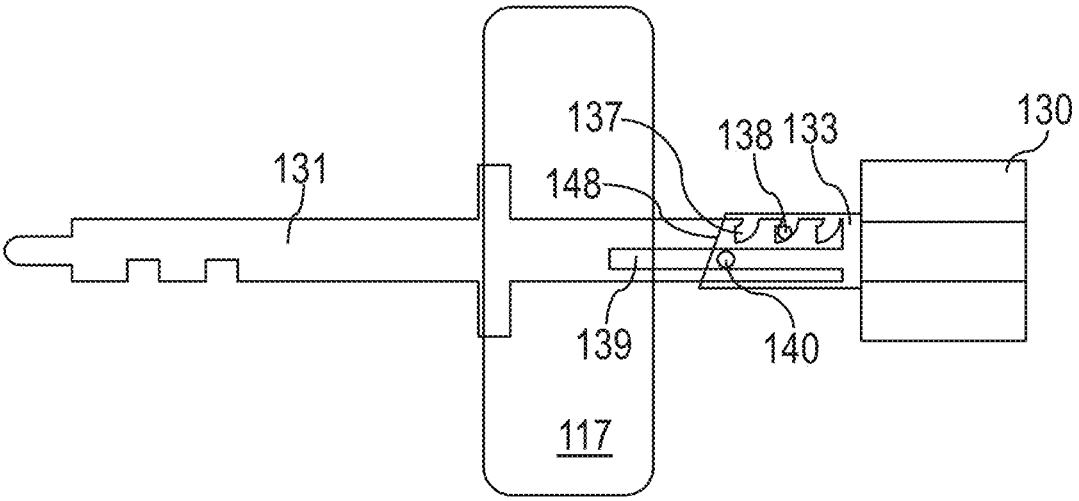
FIG. 14A is a side schematic view of another embodiment of a button and a spacer bushing in a first position.
Figure 14B:
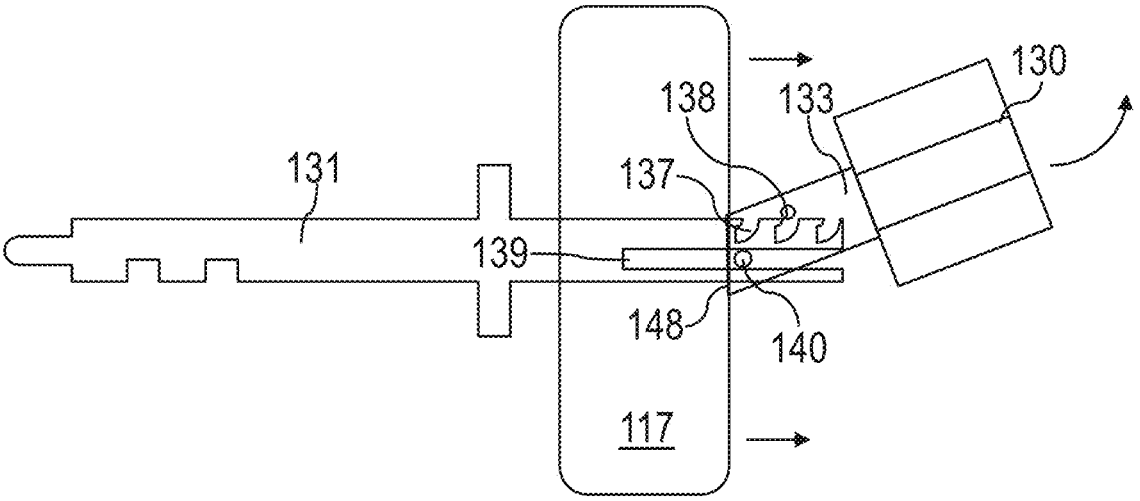
FIG. 14B is a side schematic view of the button and spacer bushing of FIG. 14A in a second position.

FIGS. 14A-14B are side schematic views of another embodiment of a button 130 disposed adjacent a spacer bushing 117 demonstrating the ability of the button to avoid damage to itself and to the spacer bushing in the case of improper installation or disassembly. According to the embodiment shown in FIGS. 14A-14B, the shank 131 and button 130 are similar to that of FIGS. 13A-13B. The shank 131 includes arcuate receptacles 137 and a slot 139. Additionally, as in FIGS. 13A-13B, a slot 139 is open on one end to allow the pin 140 to selectively enter or exit the slot. As shown in FIG. 14A, the spacer bushing 117 is spaced from the button 130, and during normal operation the spacer bushing does not contact or otherwise interfere with the movement of the button 130 and shank 131 between a depressed position and a released position. In FIG. 14A, the button 130 may be in a normal operative position where the button 130 is released and actuable to a depressed position to change the state of an associated lock body. According to the embodiment of FIGS. 14A-14B, the button coupler 133 includes an inclined end 148 which faces the spacer bushing 117 (e.g., toward an interior of the door). The inclined end 148 is configured to contact the spacer bushing 117 in case of improper disassembly and inhibit damage to the button and/or spacer bushing.

FIG. 14B depicts one example of an improper disassembly of the spacer bushing 117, where the spacer bushing is pulled prior to appropriate removal of the button 130 and/or shank 131. For fixed buttons, the inclined end 148 may strike the spacer bushing 117 and the button may not yield, preventing further removal of the spacer bushing. However, continued pulling force application may bend or otherwise damage the button, shank, and/or spacer bushing, which may require replacement of one or more components of the button assembly, lock body, or spacer bushing. However, according to the embodiment of FIGS. 14A-14B, the button 130 is automatically removed when such a force is applied, thereby avoiding this damage. As shown in FIG. 13B, the inclined end 148 strikes the spacer bushing 117, generating a moment on the button 130 shown by the curved arrow. That is, as the inclined end 148 is inclined away from the spacer bushing, and a lowermost end of the inclined end is closest to the spacer bushing 117, the spacer bushing rotates the button 130 up (e.g., counterclockwise relative to the page) as pulling force is applied to the spacer bushing. This rotation is applied until the inclined end 148 is parallel to the spacer bushing 117. In the embodiment shown in FIG. 14B, the spacer bushing 117 includes a vertical wall, and the button 130 is rotated until the inclined end 148 is substantially vertical and parallel to the vertical wall. The rotation moves the engagement projection 138 up and out of the receptacle 137 as the button 130 pivots about pin 140. Once the engagement projection 138 clears the receptacle 137, the button does not resist further movement of the spacer bushing 117. In some embodiments, the button 130 may be removed from the shank with the spacer bushing 117 as the pin 140 is moved out of the slot 139.

Figure 15A:
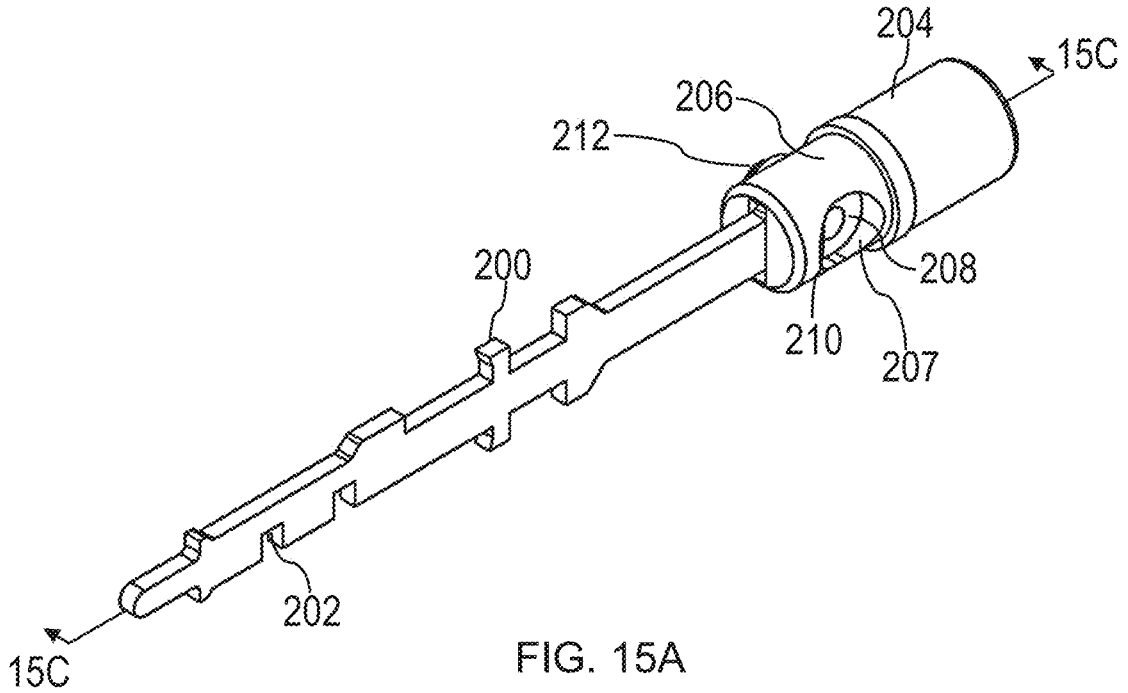
FIG. 15A is a perspective view of another embodiment of a button and a button shank.

FIG. 15A is a perspective view of another embodiment of a button 204 and a button shank 200. As shown in FIG. 15A, the button shank is similar to previously described embodiments. The shank includes a plurality of lock body receptacles 202 that are configured to allow the shank to be coupled to other portions of the lock body and transmit force. For example, in some embodiments, one or more lock body projections may engage at least one of the lock body receptacles to couple the shank to the lock body. As shown in FIG. 15A, the button 204 is coupled to the shank 200 via a button coupler 206. According to the embodiment of FIG. 15A, the button coupler includes a actuator which is actuable by an operator to selectively decouple the button 204 from the shank 200 to allow the button to be moved relative to the shank so that the overall length of the button assembly may be adjusted. The actuator includes a shaft 210 which extends through a slot formed in the shank 200 (see FIG. 15C, for example). The shaft 210 is riveted to a position marker 208 which is configured to selectively engage the slot of the shank. Of course, in other embodiments any suitable coupling between the shaft and the position marker may be employed, including, but not limited to, adhesive and press fit arrangements, as the present disclosure is not so limited. The actuator also includes a switch 212 which is configured to be used by an operator to move the position marker between an engaged position and a disengaged position, as will be discussed further with reference to FIGS. 16A-16B.

Figure 15B:
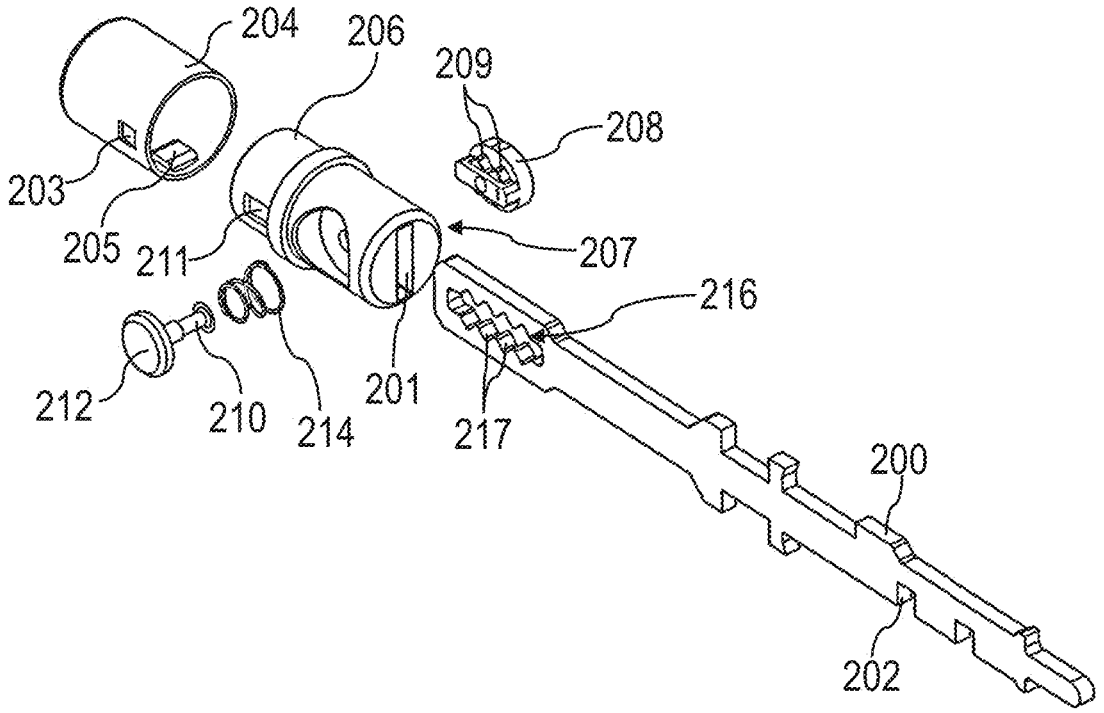
FIG. 15B is an exploded view of the button and button shank of FIG. 15A.

FIG. 15B is an exploded view of the button 204 and button shank 200 of FIG. 15A. As shown in FIG. 15B, the button 204 is a push button which is configured to be attached to the button coupler 206. The button 204 includes a latch 203 and a guide 205. The latch is a snap fit latch and is configured to engage a depression 211 formed on the button coupler, such that the button 204 may not be non-destructively removed from the button coupler 206 in a longitudinal direction. The guide 205 is configured to be received in a guide channel of the button coupler, and is configured to inhibit relative rotation of the button 204 and the button coupler 206. Of course, any suitable interface between the button 204 and the button coupler may be employed, as the present disclosure is not so limited. In some embodiments, the button 204 and button coupler 206 may be formed as a single integrated piece.

As clearly shown in FIG. 15B the actuator includes a position marker 208, a shaft 210, and a switch 212. The shaft 210 is configured to extend through a slot 216 formed in the shank 200. According to the embodiment of FIG. 15B, the slot is capped on both ends. Accordingly, when the shaft 210 is received in the slot, the button coupler 206 may not be fully removable from the shank 200, but may be decoupled so that the shaft may be moved along the length slot 216. Of course, in other embodiments the slot may be open such that the button is fully removable from the shank 200, as the present disclosure is not so limited. As shown in FIG. 15B, the slot 216 includes a plurality of receptacles 217 formed as notches. The receptacles are configured to selectively receive engagement projections 209 of the position marker 208. According to the embodiment of FIG. 15B, the position marker 208 is received in a position marker hole 207 formed in the button coupler 206. The position marker hole is formed such that the position marker is configured to move transverse (e.g., perpendicular) to a longitudinal axis of the shank 200 and button coupler 206. The shank is configured to be received in a channel 201 of the button coupler. As will be discussed further with reference to FIGS. 16A-16B, the position marker 208 is configured to move between an engaged position where the position marker is engaged with the slot 216 and a disengaged position where the position marker is disengaged with the slot. In the disengaged position, the shaft 210 and correspondingly the button coupler 206 may be slid relative to the shank 200 so that the position of the button 204 relative to the shank may be changed. The actuator of FIG. 15B includes a compression spring 214 configured to bias the position marker toward the engaged position. The compression spring is positioned between the button coupler 206 and the switch 212 around the shaft 210 and is configured to bias the switch away from the button coupler. Accordingly, to move the position marker to the engaged position, the biasing force of the spring 214 is overcome by the application of force to the switch 212 by an operator.

Figure 15C:
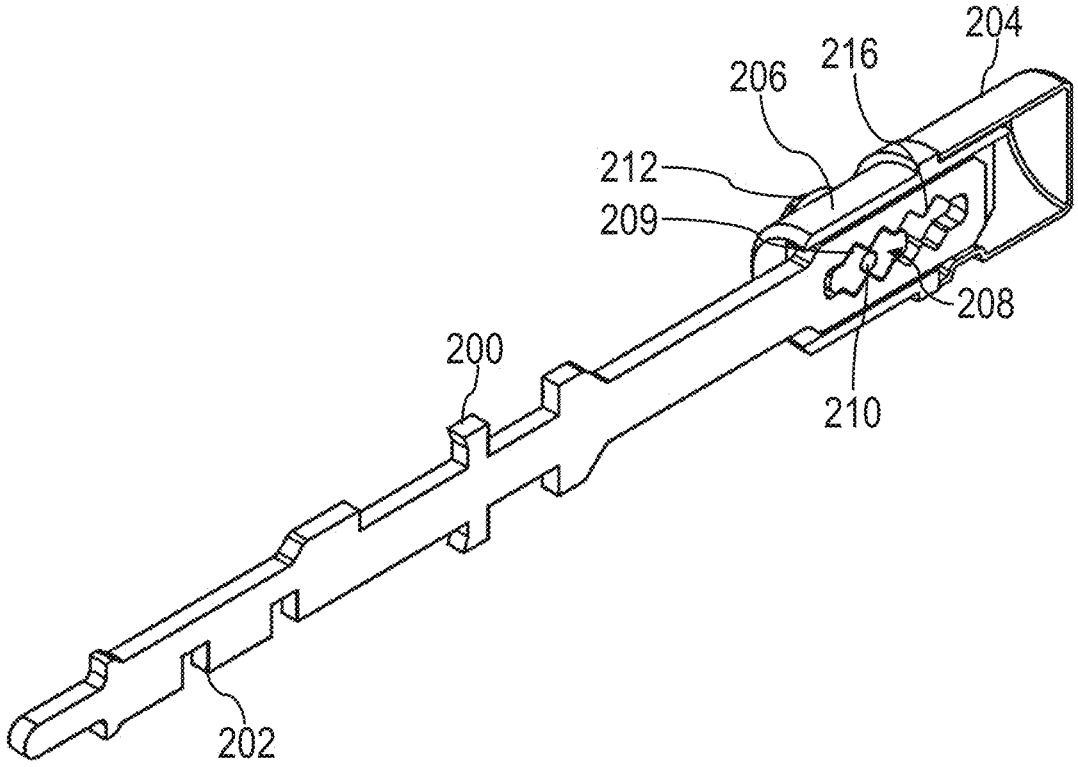
FIG. 15C is a cross-sectional view of the button and button shank of FIG. 15A taken along line 15C-15C.

FIG. 15C is a cross-sectional view of the button 204 and button shank 200 of FIG. 15A taken along line 15C-15C. FIG. 15C depicts the button 204 and shank 200 in a state where the button is coupled to the shank 200 so that force may be transmitted from the button to the shank along a longitudinal axis of the shank. Specifically, FIG. 15C shows the position marker 208 engaged with the slot 216 so that the button coupler 206 is not able to slide relative to the shank 200. As shown in FIG. 15C, the position marker includes at least one engagement projection 209. In particular, the position marker of FIG. 15C includes two engagement projections engaged with two receptacles of the slot 216 so that the position marker and slot inhibit any relative movement of the button and shank. According to the depicted embodiment, the slot includes four receptacles, such that there are three positions available for the position marker to engage the slot. Of course, any suitable number of projections may be employed on a position marker, including a single projection, as the present disclosure is not so limited. Likewise, in other embodiments the slot 216 may include any suitable number of receptacles, including a single receptacle or two receptacles, as the present disclosure is not so limited. According to the embodiment of FIG. 15C, each receptacle and engagement projection is mirrored across a longitudinal axis of the shank 200. In this manner, each projection and receptacle engagement is reflected across the shaft 210, which inhibits generation of moments on the button coupler 206. Of course, in other embodiments, a projection and receptacle may be positioned in a single side of a longitudinal axis of the shank, as the present disclosure is not so limited.

Figure 16A:
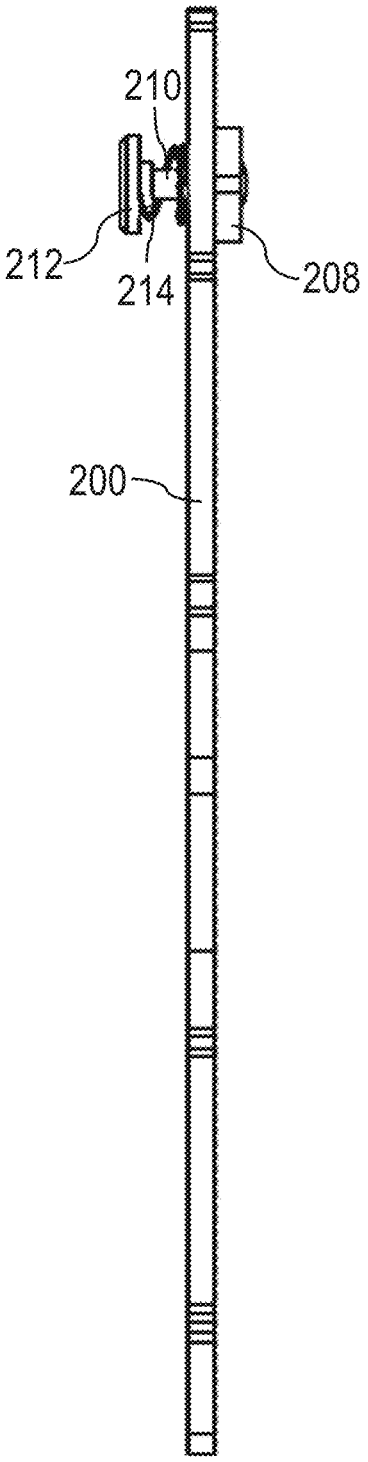
FIG. 16A is a top view of another embodiment of a button assembly in a first position.
Figure 16B:
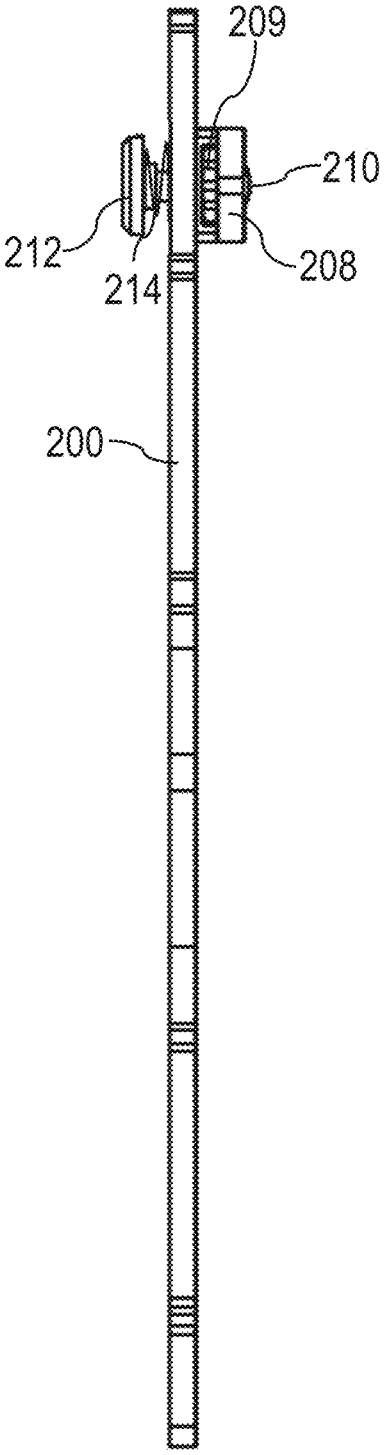
FIG. 16B is a top view of the button assembly of FIG. 16A in a second position.

FIG. 16A is a top view of another embodiment of a button assembly in a first position and FIG. 16B is a top view of the button assembly in a second position. According to the embodiment of FIGS. 16A-16B, the button assembly is like that of FIGS. 15A-15C, except the button coupler and button have been omitted for clarity. That is, the button assembly includes a shank 200 which is couplable to a button with an actuator. The actuator includes a shaft 210 that extends through a slot of the shank 200. The actuator also includes a position marker 208, a switch 212, and a spring 214. The first position shown in FIG. 16A corresponds to an engaged position of the position marker 208. That is, one or more engagement projections of the position marker are engaged with corresponding receptacles formed in a slot of the shank 200. The second position shown in FIG. 16B corresponds to a disengaged position of the position marker 208. As shown in FIG. 16B, the switch 212 has been moved transversely relative to a longitudinal axis of the shank 200 (e.g., right relative to the page). Correspondingly, the spring 214 has been compressed and the position marker has been moved away from the shank 200. As a result, the engagement projections 209 of the position marker have been removed from the slot formed in the shank 200. Accordingly, in the position of FIG. 16B, the actuator may be moved linearly relative to the shank 200 along the length of the slot to correspondingly adjust a button position. The spring 214 biases the position marker 208 toward the engaged position by applying force urging the switch 212 away from the shank 200. Accordingly, when an operator releases the switch 212, the spring 214 may move the position marker back to the engaged position shown in FIG. 16A.

Figure 17A:
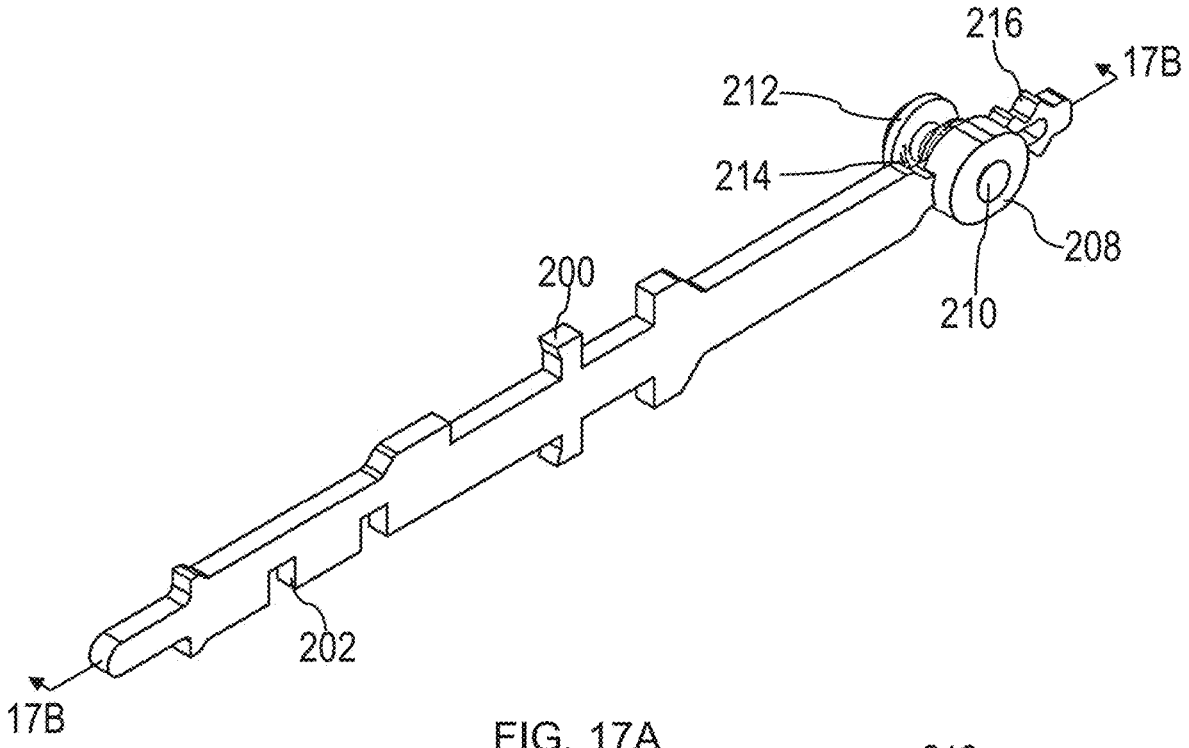
FIG. 17A is a perspective view of yet another embodiment of a button assembly.
Figure 17B:
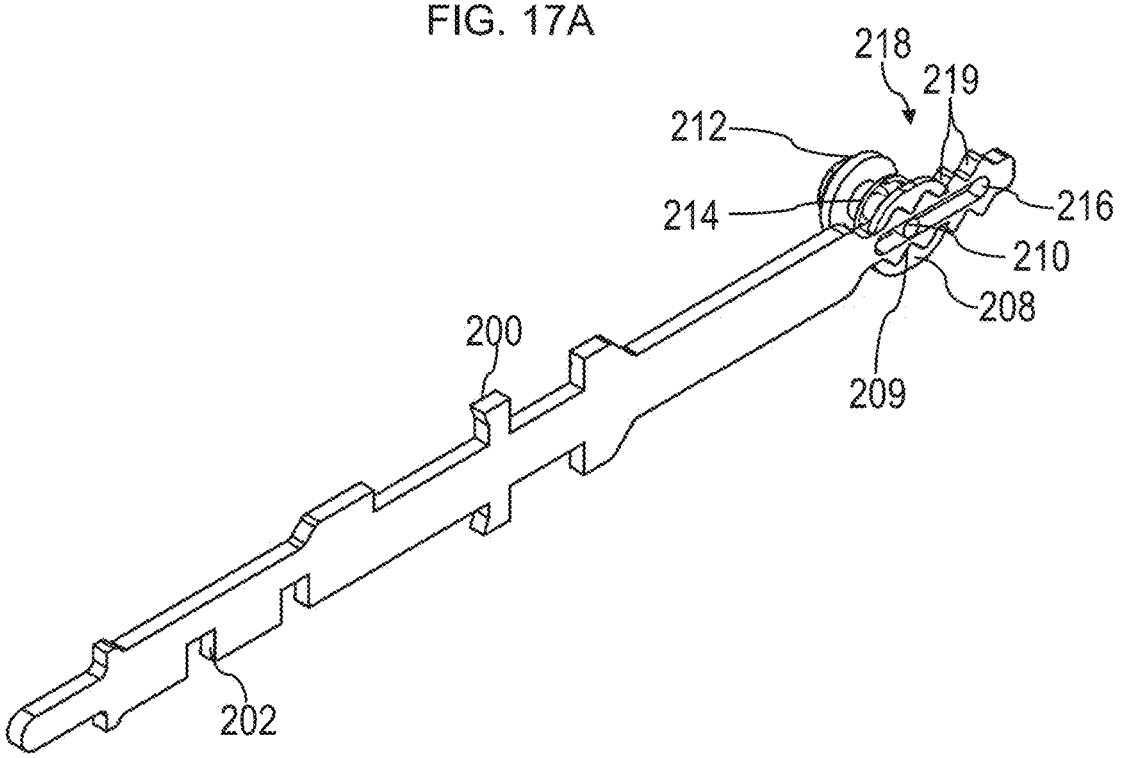
FIG. 17B is a cross-sectional view of the button assembly of FIG. 17A taken along line 17B-17B.

FIG. 17A is a perspective view of yet another embodiment of a button assembly and FIG. 17B is a cross-sectional view of the button assembly taken along line 17B-17B in FIG. 17A. The embodiment of FIGS. 17A-17B are similar to those of FIGS. 15A-16B. However, in contrast to those embodiments, the shank 200 includes an external profile 218 including at least two receptacles 219. Specifically, the external profile 218 includes three receptacles 219 which are configured to receive a complementary engagement projection 209 of a position marker 208 of an actuator. According to the embodiment of FIGS. 17A-17B, the actuator includes a shaft 210 extending through a slot 216 formed in the shank. However, the slot 216 does not include any receptacles or projections, and instead merely provides a space through which the shaft 210 can slide. Like the other embodiments, the actuator also includes a switch 212 operable by an operator and a spring 214 configured to bias the position marker toward an engaged position. According to the embodiment of FIGS. 17A-17B, the shank 200 is received inside of the position marker 208 instead of the shank receiving the position marker. Accordingly, when the position marker is in an engaged position the projection 209 of the position marker is engaged with the receptacles 219 of the external profile. When the position marker is in a disengaged position, the external profile is removed from the position marker so that the shaft 210 is allowed to slide along the slot 216.

It should be noted that while a position marker includes engagement projections and the shank includes receptacles in the embodiments of FIG. 15A-17B, in other embodiments the arrangement may be reversed. For example, the shank may include engagement projections and the position marker may include receptacles. In some embodiments, a position marker or shank may include both engagement projections and receptacles. Accordingly, the specific arrangement of complementary receptacles and engagement projections may be varied and provided in any suitable number, as the present disclosure is not so limited.

While the present teachings have been described in conjunction with various embodiments and examples, it is not intended that the present teachings be limited to such embodiments or examples. On the contrary, the present teachings encompass various alternatives, modifications, and equivalents, as will be appreciated by those of skill in the art. Accordingly, the foregoing description and drawings are by way of example only.

What is claimed is:

1. An adjustable button assembly comprising:

a shank having a first end and a second end, wherein the shank is configured to connect to one or more components of a door lock on the second end; and a button including a button coupler;

wherein one of the first end of the shank and the button coupler includes at least one engagement projection and the other of the first end of the shank and the button coupler includes at least two receptacles;

wherein the at least one engagement projection is configured to releasably engage a receptacle of the at least two receptacles;

wherein when the at least one engagement projection is engaged with one of the at least two receptacles the button is configured to transmit force to the shank along a longitudinal axis of the shank; and wherein the button is configured to rotate about an axis transverse to the longitudinal axis of the shank to move an engagement projection of the at least one engagement projection into or out of engagement with a receptacle of the at least two receptacles.

2. The adjustable button assembly of claim 1, wherein the at least two receptacles include a first plurality of notches disposed on a first side of the shank and a second plurality of notches disposed on a second side of the shank, wherein the first side and the second side are opposite one another.

3. The adjustable button assembly of claim 1, wherein the at least two receptacles includes a plurality of receptacles disposed on a first side of the shank and a slot extending parallel to the longitudinal axis of the shank, and wherein the button coupler includes a pin disposed in the slot.

4. The adjustable button assembly of claim 3, wherein the plurality of receptacles have an arcuate shape which curves toward the second end of the shank.

5. The adjustable button assembly of claim 1, wherein the at least two receptacles comprise at least four receptacles defining at least two button positions.

6. The adjustable button assembly of claim 1, when the at least one engagement projection is engaged with one of the at least two receptacles, the button transmits torque to the shank when rotated about the longitudinal axis of the shank.

7. The adjustable button assembly of claim 6, wherein the button coupler includes a channel configured to receive the shank.

8. The adjustable button assembly of claim 1, wherein the shank is a rectangular prism.

9. The adjustable button assembly of claim 1, wherein the second end of the shank includes one selected from the group of at least two lock body receptacles and at least two lock body projections.

10. The adjustable button assembly of claim 9, wherein the second end of the shank includes the at least two lock body receptacles, wherein the at least two lock body receptacles include a first notch disposed on a first side of the shank and a second notch disposed on a second side of the shank opposite the first side.

11. The adjustable button assembly of claim 9, wherein the at least two lock body receptacles include a notch disposed on a side of the shank and a lock body slot extending in a direction parallel to the longitudinal axis of the shank.

12. An adjustable button assembly comprising:

a shank having a first end and a second end, wherein the shank is configured to connect to one or more components of a door lock on the second end; and a button including a button coupler;

wherein one of the first end of the shank and the button coupler includes at least one engagement projection and the other of the first end of the shank and the button coupler includes at least two receptacles;

wherein the at least one engagement projection is configured to releasably engage a receptacle of the at least two receptacles;

wherein when the at least one engagement projection is engaged with one of the at least two receptacles the button is configured to transmit force to the shank along a longitudinal axis of the shank; and wherein the button coupler includes an actuator having a position marker, wherein the position marker includes the at least one engagement projection.

13. The adjustable button assembly of claim 12, wherein the position marker is configured to be moved transverse to the longitudinal axis of the shank between an engaged position and a disengaged position, wherein in the engaged position the at least one engagement projection is engaged with the at least two receptacles.

14. The adjustable button assembly of claim 13, wherein the position marker is biased toward the engaged position.

15. The adjustable button assembly of claim 12, wherein the at least two receptacles are formed in a slot formed in the shank, wherein the position marker is configured to move into the slot in an engaged position and out of the slot in a disengaged position.

16. The adjustable button assembly of claim 12, wherein the at least two receptacles are formed in an exterior profile of the shank, wherein the position marker is configured to receive the shank in an engaged position.

17. The adjustable button assembly of claim 12, when the at least one engagement projection is engaged with one of the at least two receptacles, the button transmits torque to the shank when rotated about the longitudinal axis of the shank.

18. The adjustable button assembly of claim 12, wherein the button coupler includes a channel configured to receive the shank.

19. A button assembly comprising:

a shank having a first end and a second end;

a button disposed on the first end of the shank; and a lock body coupler configured to be secured to a lock body of a door lock, wherein the lock body coupler is disposed on the second end of the shank, and wherein the lock body coupler includes a first spring and a second spring, wherein the first spring and the second spring have different spring coefficients.

20. The button assembly of claim 19, wherein the first spring is disposed between the lock body and the second spring.

21. The button assembly of claim 20, wherein the spring coefficient of the first spring is larger than the spring coefficient of the second spring.

22. The button assembly of claim 19, further comprising a handle, wherein the first spring and the second spring urge the button toward the handle.

23. The button assembly of claim 19, wherein the first spring and the second spring are compression springs.

* * * * *